US008037654B2

(12) United States Patent
Hanya et al.

(10) Patent No.: US 8,037,654 B2
(45) Date of Patent: Oct. 18, 2011

(54) FLOOR STRUCTURE INCLUDING PLATE-SHAPED SUPPORTING PORTION

(75) Inventors: Koji Hanya, Tokyo (JP); Nariaki Nakayasu, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 130 days.

(21) Appl. No.: 12/225,719

(22) PCT Filed: Dec. 28, 2007

(86) PCT No.: PCT/JP2007/075279

§ 371 (c)(1),
(2), (4) Date: Sep. 29, 2008

(87) PCT Pub. No.: WO2008/081929

PCT Pub. Date: Jul. 10, 2008

(65) Prior Publication Data

US 2009/0064634 A1 Mar. 12, 2009

(30) Foreign Application Priority Data

Jan. 4, 2007 (JP) ..... 2007-000087
Dec. 11, 2007 (JP) ..... 2007-319914

(51) Int. Cl.
*E04C 3/00* (2006.01)

(52) U.S. Cl. ..... 52/579; 52/588.1; 52/591.4; 52/592.1; 52/843

(58) Field of Classification Search ..... 52/414, 52/783.1, 784.14, 784.15, 425, 263, 793.1, 52/793.11, 579, 843, 588.1, 591.4, 592.1
See application file for complete search history.

(56) References Cited

U.S. PATENT DOCUMENTS

| | | | | | |
|---|---|---|---|---|---|
| 14,208 | A | * | 2/1856 | Terry | 52/579 |
| 1,972,570 | A | * | 9/1934 | Moore | 52/579 |
| 1,988,314 | A | * | 1/1935 | Higley | 52/579 |
| 2,026,278 | A | * | 12/1935 | Higley | 52/579 |
| 2,899,028 | A | * | 8/1959 | Walker | 52/579 |
| 3,875,707 | A | * | 4/1975 | Horn | 52/184 |
| 5,048,257 | A | * | 9/1991 | Luedtke | 52/747.1 |

(Continued)

FOREIGN PATENT DOCUMENTS

CN 1492805 A 4/2004

(Continued)

OTHER PUBLICATIONS

Taiwanese Patent Office Action: Application No. 096150774.

(Continued)

*Primary Examiner* — Brian Glessner
*Assistant Examiner* — Joshua Ihezie
(74) *Attorney, Agent, or Firm* — Birch, Stewart, Kolasch & Birch, LLP

(57) ABSTRACT

A floor structure includes a plurality of structural metal components that each have: a plate-shaped supporting portion that is laid either perpendicular or oblique to an installation surface; a plate-shaped top flange that extends from a top end portion of the supporting portion in parallel with the installation surface; a plate-shaped bottom flange that extends from a bottom end portion of the supporting portion in parallel with the installation surface and in the opposite direction from the top flange, wherein the structural metal components are laid on a flat surface in parallel with each other such that the top flange of one of the mutually adjacent structural metal components covers the bottom flange of the other of the mutually adjacent structural metal material.

34 Claims, 34 Drawing Sheets

U.S. PATENT DOCUMENTS

| | | | | |
|---|---|---|---|---|
| 5,050,362 | A | 9/1991 | Tal et al. | |
| 5,134,825 | A | 8/1992 | Berridge | |
| 5,560,150 | A * | 10/1996 | Pearson | 52/79.14 |
| 5,758,467 | A | 6/1998 | Snear et al. | |
| 6,106,201 | A | 8/2000 | Bourdouxhe | |
| 6,912,822 | B2 * | 7/2005 | Vos | 52/522 |
| 7,051,489 | B1 * | 5/2006 | Swiszcz et al. | 52/783.18 |
| 7,169,459 | B2 * | 1/2007 | Lichodziejewski et al. | 428/188 |
| 7,520,100 | B1 | 4/2009 | Herrman et al. | |
| 2003/0110730 | A1 * | 6/2003 | Vos | 52/588.1 |
| 2003/0233801 | A1 * | 12/2003 | Pace | 52/414 |
| 2005/0188638 | A1 * | 9/2005 | Pace | 52/414 |
| 2006/0016138 | A1 * | 1/2006 | Blount | 52/263 |
| 2006/0075707 | A1 * | 4/2006 | Cretti | 52/414 |
| 2009/0126308 | A1 | 5/2009 | Hannig et al. | |
| 2010/0275541 | A1 | 11/2010 | Prinz | |
| 2010/0293877 | A1 | 11/2010 | Harris et al. | |
| 2010/0293878 | A1 | 11/2010 | van Groen | |

FOREIGN PATENT DOCUMENTS

| | | | |
|---|---|---|---|
| EP | 0164296 | A2 | 12/1985 |
| JP | 7-310364 | A | 11/1995 |
| JP | 11-293834 | A | 10/1999 |
| JP | 2003-119946 | A | 4/2003 |
| JP | 2003-1936600 | A | 7/2003 |
| JP | 2003-293017 | A | 10/2003 |
| JP | 2005-320722 | A | 11/2005 |
| JP | 3781674 | B2 | 3/2006 |
| TW | 553261 | | 9/2003 |
| TW | 269823 | B | 1/2007 |
| WO | WO 86/05532 | | 9/1986 |

OTHER PUBLICATIONS

USPTO Office Action in related U.S. Appl. No. 12/829,121 on Feb. 16, 2011.

* cited by examiner

| | (a) CONVENTIONAL TECHNOLOGY | (b) PRESENT INVENTION | (c) PRESENT INVENTION |
|---|---|---|---|
| |   |   |   |
| A ($mm^2$) | 3,519 | 2,659.5 | 3,519 |
| I ($mm^4$) | 22,428,052 | 19,815,102 | 28,416,176 |
| I/A ($mm^2$) | 6,374 | 7,451 | 8,075 |
| I/A RATIO | 1 | 1.169 | 1.267 |

FLOOR STRUCTURE INCLUDING PLATE-SHAPED SUPPORTING PORTION

TECHNICAL FIELD

The present invention relates to a floor structure.

Priority is claimed on Japanese Patent Application No. 2007-000087, filed Jan. 4, 2007, and Japanese Patent Application No. 2007-319914, filed Dec. 11, 2007, the contents of which are incorporated herein by reference.

BACKGROUND ART OF THE INVENTION

When the structural framework of an erected construction such as a building or house is constructed using a steel structure (S structure), a steel reinforced concrete structure (RC structure), or a steel framed reinforced concrete structure (SRC structure), normally, the floor structure of the erected construction is formed by a concrete floor structure or by a composite structure which combines steel deck plates and an RC structure (referred to below as an RC floor structure), however, building a steel-construction floor that is formed solely from steel is also possible with current construction technology.

Prior art relating to the aforementioned floor structures is disclosed, for example, in Patent documents 1 to 5 shown below. Specifically, a floor structure that uses folded plate-shaped steel floor panels is described in Patent documents 1 and 2. A method of constructing a floor using deck plates is described in Patent document 3. This construction method is a technology for an RC floor structure in which a plurality of beam materials are assembled as a base, and after this assembled unit has been put in position, concrete is laid over the deck plates. A floor structure in which a plurality of box-shaped steel materials are arranged in parallel is described in Patent document 4. Technology for an RC floor structure in which a plurality of folded deck plates are arranged in parallel and concrete is then laid over the deck plates is described in Patent document 5.

Patent document 1: Japanese Unexamined Patent Application, First Publication No. 2003-119946

Patent document 2: Japanese Patent No. 3781674

Patent document 3: Japanese Unexamined Patent Application, First Publication No. H11-293834

Patent document 4: Japanese Unexamined Patent Application, First Publication No. 2003-293017

Patent document 5: Japanese Unexamined Patent Application, First Publication No. 2005-320722

DETAILED DESCRIPTION OF THE INVENTION

Problems to be Solved by the Invention

It has, however, been more common to use an RC floor structure rather than a steel structure for the floor structure of an erected construction. The reason for this is that, in a steel floor structure, because noise generated on the floor above is more easily transmitted to the floor below compared with an RC floor structure in which concrete is laid in addition to steel, vibration and noise are easily generated thus creating the problem of impact noise.

Moreover, when a steel floor structure is being built, in a floor structure in which, for example, the box-shaped steel material described in the aforementioned Patent document 4 are used, because the box-shaped steel materials are extremely bulky, an RC floor structure is advantageous from the standpoints of ease of construction and transporting.

However, in the aforementioned Patent documents 1 and 2, in a floor structure in which steel floor panels are used, although devices are employed to suppress vibration and noise, the problem has been that no examination has been made of the costs involved in manufacturing such floor structures and in transporting the steel material used for this manufacturing.

The present invention was conceived in view of the above described circumstances, and it is an object thereof to provide a new and improved floor structure that makes it possible to reduce the costs involved in both manufacturing the floor structure and in transporting the steel materials used in the manufacturing thereof.

Means for Solving the Problem

In order to solve the above described problems, the present invention employs the following. Namely, the floor structure of the present invention includes a plurality of structural metal components that each have: a plate-shaped supporting portion that is laid either perpendicular or oblique to an installation surface; a plate-shaped top flange that extends from a top end portion of the supporting portion in parallel with the installation surface; a plate-shaped bottom flange that extends from a bottom end portion of the supporting portion in parallel with the installation surface and in the opposite direction from the top flange, wherein the structural metal components are laid on a flat surface in parallel with each other such that the top flange of one of the mutually adjacent structural metal components covers the bottom flange of the other of the mutually adjacent structural metal material.

According to the above described floor structure, as a result of a structural metal component being laid as the floor of an erected construction, a supporting portion that is laid either perpendicular or oblique to an installation surface transmits force from a top flange to a bottom flange and the top flange supports a load on the floor, while the bottom flange supports the load and also supports the structural metal component itself. Here, the structural metal component can be manufactured using less material than is used for box-shaped steel. Moreover, because a plurality of other structural metal components can be stacked on top of one structural metal component, it is possible to reduce the space taken up by the stacked structural metal components. Furthermore, when the structural metal components are being transported, it is possible to transport a large number of the structural metal components in a single load. As a result, it is possible to reduce the costs involved in both manufacturing a floor structure and in transporting the steel materials used in the manufacturing thereof.

It may be arranged such that at least one of the supporting portion, the top flange, and the bottom flange is provided with a rib that protrudes from the surface thereof.

In this case, it is possible to increase the out-of-plane flexural rigidity of the supporting portion, the top flange, and the bottom flange of a floor structure, and improve localized buckling strength. Accordingly, it is possible to lighten the weight of the structural metal components which, in turn, makes it possible to reduce manufacturing costs and increase profitability. Note that the rib may be formed by bending the structural metal component itself, or may be formed by attaching a reinforcing component by means of welding or the like.

It may be arranged such that an angle formed between the supporting portion and the top flange or bottom flange is between 30° and 150°.

In this case, because the angle of the supporting portion is in a range between 30° and 150°, structural properties (i.e., the geometrical moment of inertia (I/A) per unit surface area) either equivalent to or superior to box-shaped steel of the same height can be provided, which results in a floor structure having excellent structural properties being obtained.

It may be arranged such that a distal end portion of the top flange of one of the mutually adjacent structural metal components is connected to a top end portion of the supporting portion of the other of the mutually adjacent structural metal components.

In this case, in a floor structure in which a plurality of structural metal components are laid in parallel, it is possible to form a continuous top surface on the floor structure.

It may be arranged such that the supporting portion is provided with a connection surface that is formed on a top end portion thereof at a lower position than the top surface of the top flange; and the distal end portion of the top flange of one of the mutually adjacent structural metal components is connected to the connection surface of the other of the mutually adjacent structural metal components.

In this case, it is possible to arrange the top surfaces of the top flanges of adjacent structural metal components on the same plane.

It may be arranged such that the top flange is provided with a thin portion that is formed at the distal end portion thereof; and the thin portion of one of the mutually adjacent structural metal components is connected to the connection surface of the other of the mutually adjacent structural metal components.

In this case, positioning is made easier when the structural metal components are being laid. In addition, it is possible to arrange the top surfaces of the top flanges of adjacent structural metal components on the same plane.

It may be arranged such that the supporting portion is provided with a fitting portion that is formed on a top end portion thereof; and the distal end portion of the top flange of one of the mutually adjacent structural metal components is fitted to the fitting portion of the other of the mutually adjacent structural metal components.

In this case, it is possible to easily connect one structural metal component to an adjacent structural metal component, which results in an improvement in workability. It also becomes difficult for the structural metal components to move, and thereby it is possible to increase the in-plane shear rigidity of the floor structure.

It may be arranged such that the supporting portion is provided at the top end portion thereof with a protruding portion that protrudes in the extending direction of the bottom flange; the top flange is provided at the distal end portion thereof with a step portion having a surface that is lower than the top surface of the top flange; and the step portion of one of the mutually adjacent structural metal components is connected to the protruding portion of the other of the mutually adjacent structural metal components.

In this case, positioning is made easier when the structural metal components are being laid. In addition, it is possible to arrange the top surfaces of the top flanges of adjacent structural metal components on the same plane.

It may be arranged such that the top flange is provided on the distal end portion thereof with a connection protruding portion that extends in a longitudinal direction; the supporting portion is provided either in the top end portion thereof and/or in the top flange adjacent to the top end portion thereof with a connection aperture portion that extends in the longitudinal direction; and the connection protruding portion in one of the mutually adjacent structural metal components is inserted into the connection aperture portion in the other of the mutually adjacent structural metal components.

In this case, because joins between the top flanges of mutually adjacent structural metal components are further strengthened, it is possible to increase the in-plane shear rigidity of the floor.

It may be arranged such that a plurality of the connection protruding portions and the connection aperture portions are provided separately from each other in the longitudinal direction.

In this case, it is possible to efficiently join together the top flanges of mutually adjacent structural metal components.

It may be arranged such that a distal end portion of the bottom flange of one of the mutually adjacent structural metal components is connected to a bottom end portion of the supporting portion of the other of the mutually adjacent structural metal components.

In this case, in a floor structure in which a plurality of structural metal components are laid in parallel, it is possible to form a continuous bottom surface on the floor structure.

It may be arranged such that the supporting portion is provided with a connection surface that is formed on a bottom end portion thereof at a higher position than the bottom surface of the bottom flange; and the distal end portion of the bottom flange of one of the mutually adjacent structural metal components is connected to the connection surface of the other of the mutually adjacent structural metal components.

In this case, it is possible to arrange the bottom surfaces of the bottom flanges of adjacent structural metal components on the same plane.

It may be arranged such that the bottom flange is provided with a thin portion that is formed at the distal end portion thereof; and the thin portion of one of the mutually adjacent structural metal components is connected to the connection surface of the other of the mutually adjacent structural metal components.

In this case, positioning is made easier when the structural metal components are being laid. In addition, it is possible to arrange the bottom surfaces of the bottom flanges of adjacent structural metal components on the same plane.

It may be arranged such that the supporting portion is provided with a fitting portion that is formed on a bottom end portion thereof, and the distal end portion of the bottom flange of one of the mutually adjacent structural metal components is fitted to the fitting portion of the other of the mutually adjacent structural metal components.

In this case, it is possible to easily connect one structural metal component to an adjacent structural metal component, which results in an improvement in workability. It also becomes difficult for the structural metal components to move, and thereby it is possible to increase the in-plane shear rigidity of the floor structure.

It may be arranged such that the supporting portion is provided at the bottom end portion thereof with a protruding portion that protrudes in the direction in which the top flange extends; the bottom flange is provided at the distal end portion thereof with a step portion having a surface that is higher than the bottom surface of the bottom flange; and the step portion at the distal end portion of the bottom flange of one of the mutually adjacent structural metal components is connected to the protruding portion of the other of the mutually adjacent structural metal components.

In this case, positioning is made easier when the structural metal components are being laid. In addition, it is possible to arrange the bottom surfaces of the bottom flanges of adjacent structural metal components on the same plane.

It may be arranged such that the bottom flange is provided on the distal end portion thereof with a connection protruding portion that extends in a longitudinal direction; the supporting portion is provided either in the bottom end portion thereof and/or in the bottom flange adjacent to the bottom end portion thereof with a connection aperture portion that extends in the longitudinal direction; and the connection protruding portion in one of the mutually adjacent structural metal components is inserted into the connection aperture portion in the other of the mutually adjacent structural metal components.

In this case, because joins between the bottom flanges of mutually adjacent structural metal components are further strengthened, it is possible to increase the in-plane shear rigidity of the floor.

It may be arranged such that a plurality of the connection protruding portions and the connection aperture portions are provided separately from each other in the longitudinal direction.

In this case, it is possible to efficiently join together the bottom flanges of mutually adjacent structural metal components.

It may be arranged such that the distal end portion of the top flange of one of the mutually adjacent structural metal components is connected to the top end portion of the supporting portion of the other of the mutually adjacent structural metal components; and the distal end portion of the bottom flange of one of the mutually adjacent structural metal components is connected to the bottom end portion of the supporting portion of the other of the mutually adjacent structural metal components.

In this case, in a floor structure in which a plurality of structural metal components are laid in parallel, it is possible to form a continuous top surface and bottom surface on the floor structure.

It may be arranged such that the supporting portion is provided with a first connection surface that is formed on a top end portion thereof at a lower position than the top surface of the top flange; the distal end portion of the top flange of one of the mutually adjacent structural metal components is connected to the first connection surface of the other of the mutually adjacent structural metal components; the supporting portion is provided with a second connection surface that is formed on a bottom end portion thereof at a higher position than the bottom surface of the bottom flange; and the distal end portion of the bottom flange of one of the mutually adjacent structural metal components is connected to the second connection surface of the other of the mutually adjacent structural metal components.

In this case, it is possible to arrange the top surfaces of the top flanges and the bottom surfaces of the bottom flanges of adjacent structural metal components on the same planes.

It may be arranged such that the top flange is provided with a first thin portion that is formed at the distal end portion thereof; the first thin portion of one of the mutually adjacent structural metal components is connected to the first connection surface of the other of the mutually adjacent structural metal components; the bottom flange is provided with a second thin portion that is formed at the distal end portion thereof; and the second thin portion of one of the mutually adjacent structural metal components is connected to the second connection surface of the other of the mutually adjacent structural metal components.

In this case, positioning is made easier when the structural metal components are being laid. In addition, it is possible to arrange the top surfaces of the top flanges and the bottom surfaces of the bottom flanges of adjacent structural metal components on the same planes.

It may be arranged such that the supporting portion is provided with a first fitting portion that is formed on a top end portion thereof; the distal end portion of the top flange of one of the mutually adjacent structural metal components is fitted to the first fitting portion of the other of the mutually adjacent structural metal components; the supporting portion is provided with a second fitting portion that is formed on a bottom end portion thereof; and the distal end portion of the bottom flange of one of the mutually adjacent structural metal components is fitted to the second fitting portion of the other of the mutually adjacent structural metal components.

In this case, it is possible to easily connect one structural metal component to an adjacent structural metal component, which results in an improvement in workability. It also becomes difficult for the structural metal components to move, and thereby it is possible to increase the in-plane shear rigidity of the floor structure.

It may be arranged such that the supporting portion is provided at the top end portion thereof with a first protruding portion that protrudes in the direction in which the bottom flange extends; the top flange is provided at the distal end portion thereof with a first step portion having a surface that is lower than the top surface of the top flange; the first step portion of one of the mutually adjacent structural metal components is connected to the first protruding portion of the other of the mutually adjacent structural metal components; the supporting portion is provided at the bottom end portion thereof with a second protruding portion that protrudes in the direction in which the top flange extends; the bottom flange is provided at the distal end portion thereof with a second step portion having a surface that is higher than the bottom surface of the bottom flange; and the second step portion of one of the mutually adjacent structural metal components is connected to the second protruding portion of the other of the mutually adjacent structural metal components.

In this case, positioning is made easier when the structural metal components are being laid. In addition, it is possible to arrange the top surfaces of the top flanges and the bottom surfaces of the bottom flanges of adjacent structural metal components on the same planes.

It may be arranged such that the top flange is provided on the distal end portion thereof with a first connection protruding portion that extends in a longitudinal direction; the supporting portion is provided either in the top end portion thereof and/or in the top flange adjacent to the top end portion thereof with a first connection aperture portion that extends in the longitudinal direction; the first connection protruding portion in one of the mutually adjacent structural metal components is inserted into the first connection aperture portion in the other of the mutually adjacent structural metal components; the bottom flange is provided on the distal end portion thereof with a second connection protruding portion that extends in a longitudinal direction; the supporting portion is provided either in the bottom end portion thereof and/or in the bottom flange adjacent to the bottom end portion thereof with a second connection aperture portion that extends in the longitudinal direction; and the second connection protruding portion in one of the mutually adjacent structural metal components is inserted into the second connection aperture portion in the other of the mutually adjacent structural metal components.

In this case, because joins between the top flanges of mutually adjacent structural metal components and joins between the bottom flanges of mutually adjacent structural metal components are further strengthened, it is possible to increase the in-plane shear rigidity of the floor.

It may be arranged such that a plurality of the first connection protruding portions, the first connection aperture portions, the second connection protruding portions, and the second connection aperture portions are provided separately from each other in the longitudinal direction.

In this case, it is possible to efficiently join together the top flanges of mutually adjacent structural metal components and the bottom flanges of mutually adjacent structural metal components.

It may be arranged such that the mutually adjacent structural metal components are fixed together by means of semi-finished bolts, high strength bolts, drill screws, rivets, welding, or bonding.

In this case, it becomes difficult for the structural metal components to move, and thereby it is possible to increase the in-plane shear rigidity of the floor structure.

It may be arranged such that at least one of the structural metal components is a floor beam structural metal component in which a bulging portion is formed as a result of the bottom flange bulging downwards from a bottom end portion of the supporting portion.

In this case, the floor beam structural steel materials protrude below the bottom flanges of the structural metal components, and have a U-shaped cross section. Because of this, when they are laid as at least a portion of a floor structure, they function as beam components for the floor structure. Accordingly, in an erected construction which uses this type of floor beam structural metal components, it is possible to omit joists such as binding joists, and thereby achieve an improvement in workability and profitability.

It may be arranged such that at least one of a noise-proofing material, a weight, a mechanical damper, and a granular material is provided between the bottom flange and the top flange.

In this case, it is possible to prevent noise and vibration being transmitted from a floor above to a floor below. Moreover, it is also possible to install the structural metal component that is to be laid next in such a manner that it covers the bottom flange and the noise-proofing material. As a result, it is possible to reduce both the time and cost of this task.

It may be arranged such that the noise-proofing material is concrete.

In this case, in addition to it being possible to prevent noise and vibration being transmitted from a floor above to a floor below, it is also possible to increase the rigidity of a floor structure. As a result, the height of the floor structure can be lowered. Note that the concrete is positioned by suspending hardened concrete lumps from the top flange, or by pouring concrete that is still in liquid form into a space between the top flange and the bottom flange. In particular, when a noise-proofing material is formed by pouring liquid concrete, superior rigidity can be imparted to the floor structure.

It may be arranged such that at least one of electric cables, equipment piping, and ducts are provided between the bottom flange and the top flange.

In this case, it is possible to install at least one of electric cables, equipment piping, and ducts to be provided between the bottom flange and the top flange.

It may be arranged such that at least one plate material selected from a concrete panel, an aerated lightweight concrete panel (i.e., an ALC panel), a wooden board, slate, a ceramic board, a glass wool board, a plaster board, a metal panel, and a ceramic-based siding board is integrally fixed to the structural metal components on the top surface of the top flange and/or the bottom surface of the bottom flange.

In this case, the number of on-site tasks to be performed can be reduced so that, as a result, it is possible to improve workability.

It may be arranged such that the bottom flange and the supporting portion are provided with a notch portion at an end portion in the longitudinal direction thereof; and the structural metal component is connected to a top surface of the structural framework of an erected construction via the notch portion.

In this case, it is possible to limit the height between the top surface of the structural framework of an erected construction and the top surface of the structural metal components.

Advantageous Effects of the Invention

According to the present invention, it is possible to reduce the costs involved in both manufacturing a floor structure and in transporting the steel materials used in the manufacturing thereof.

DESCRIPTION OF THE REFERENCE SYMBOLS

Figure 1A:
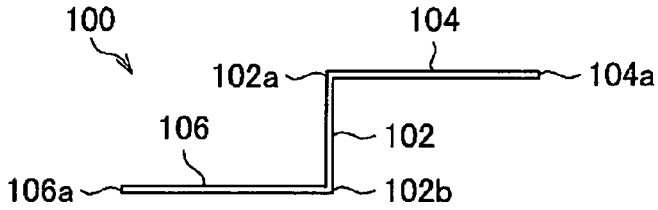
FIG. 1A is a side view showing a structural steel material according to a first embodiment of the present invention.

100, 200, 300, 400, 500, 600 . . . Structural steel material
102, 112, 122, 144, 202, 302, 402, 502, 512, 602, 610, 702 . . . Web
102*a* . . . Top end portion
102*b*, 202*b* . . . Bottom end portion
104, 204, 304, 404, 504, 604, 704 . . . Top flange
104*a*, 106*a*, 604*a*, 606*a* . . . End portion
104*b*, 106*b* . . . Protruding portion
104*c*, 106*c*, 601, 604*b*, 606*b* . . . Step portion
106, 206, 306, 406, 506, 606, 706 . . . Bottom flange
110, 120, 130, 140, 510 . . . End portion steel material
114, 146, 514, 516 . . . Flange
124 . . . First flange
126 . . . End component
128 . . . Second flange
132 . . . Shaped steel
134, 136 . . . Steel plate
142 . . . H-shaped steel
150, 152, 154, 156 . . . Rib
202*a* . . . Joining portion
204*a* . . . Projecting portion
206*a*, 302*b*, 306*a*, 406*a*, 706*a* . . . Bent portion
210, 410 . . . Drill screw
302*a*, 402*a*, 702*a* . . . Fitting portion
304*a*, 404*a*, 704*a* . . . Engaging portion
402*b*, 702*b* . . . Inclined portion
504*a*, 504*b*, 506*a*, 506*b*, 514*a* . . . Thin portion
603, 607, 613, 617 . . . Connection aperture portion
605, 609, 615, 619 . . . Connection protruding portion
700 . . . Floor beam structural steel material
802 . . . Aerated lightweight concrete panel (ALC panel)
804 . . . Plasterboard
806 . . . Piping equipment

808 . . . Electrical cabling
902, 904, 906 . . . Notched portion
908, 910, 912, 914, 612 . . . Bent portion
1002, 1006, 1008 . . . Bent rib

BEST MODE FOR CARRYING OUT THE INVENTION

Preferred embodiments of the present invention will now be described in detail with reference to the attached drawings. Note that in the present specification and drawings, components elements that have essentially the same functional structure have the same symbols, and any duplicated description thereof is omitted.

First Embodiment

Figure 1B:
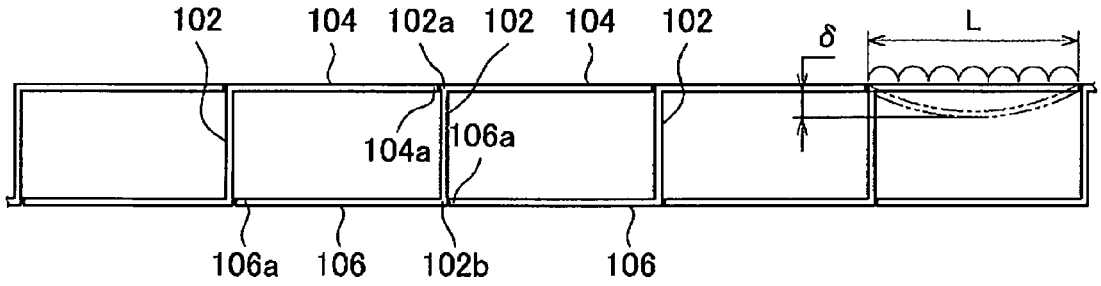
FIG. 1B is a side view showing a floor structure according to the embodiment.
Figure 2A:
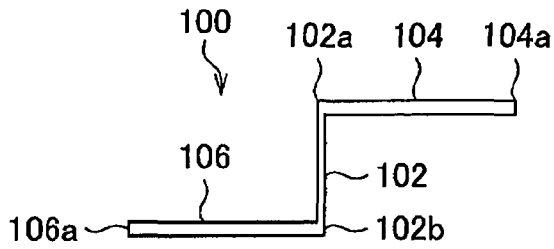
FIG. 2A is a side view showing a structural steel material according to the embodiment.
Figure 2B:
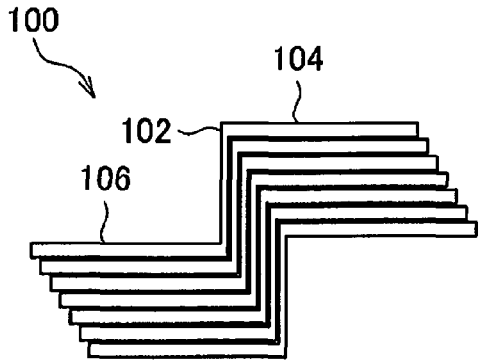
FIG. 2B is a side view showing a state in which the structural steel materials according to the embodiment are stacked.
Figure 2C:
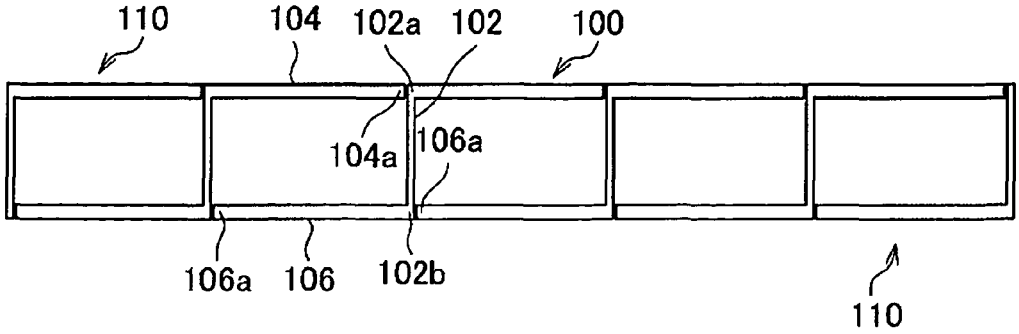
FIG. 2C is a side view showing a floor structure according to the embodiment.
Figure 3:
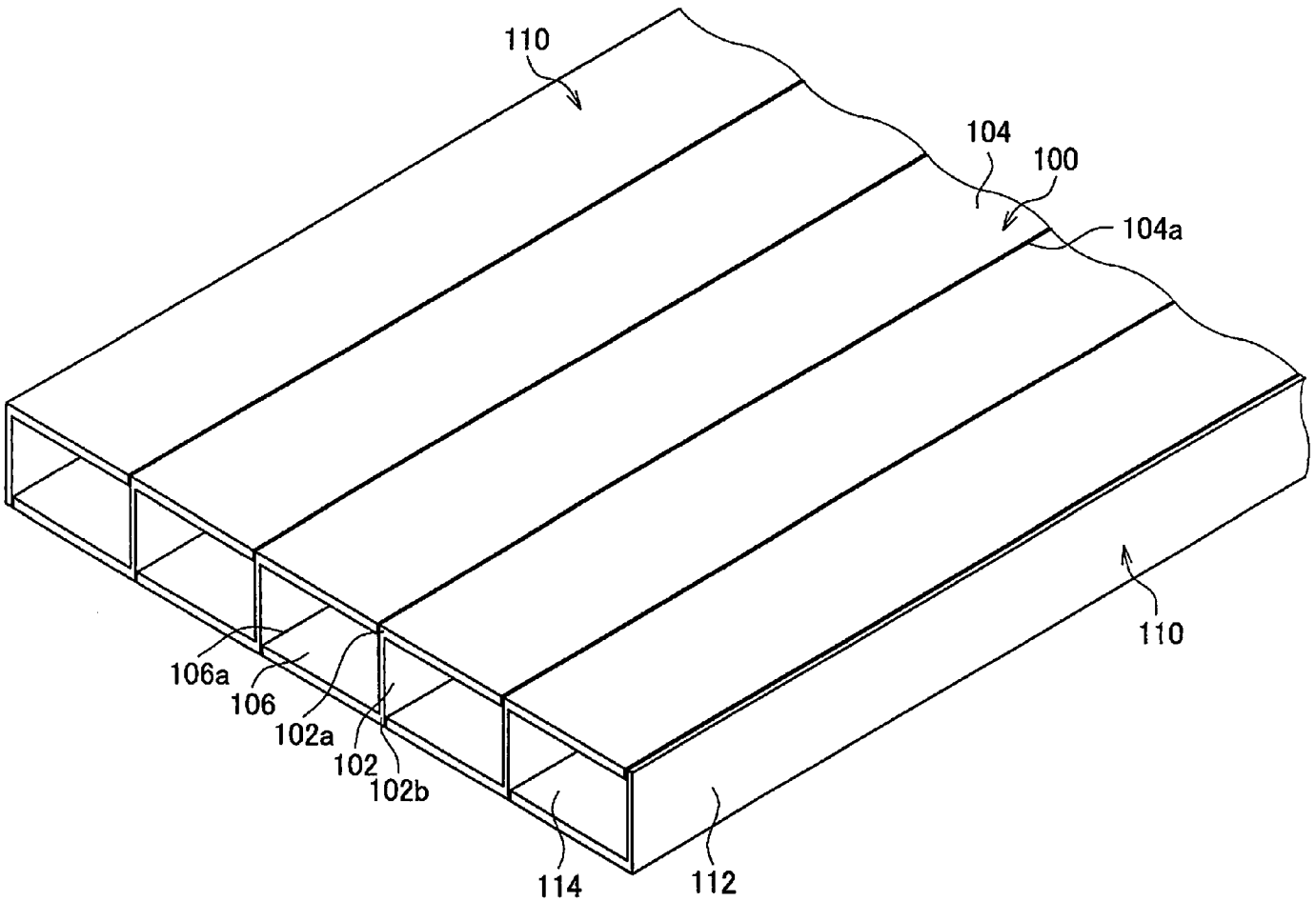
FIG. 3 is a perspective view showing the structural steel materials and the floor structure according to the embodiment.

Firstly, a structural steel material and floor structure according to a first embodiment of the present invention will be described. FIGS. 1A and 1B are side views showing the structural steel material and floor structure according to the present embodiment. FIGS. 2A to 2C are side views showing the structural steel material and floor structure according to the present embodiment. FIG. 3 is a perspective view showing the structural steel material and floor structure according to the present embodiment.

As is shown in FIGS. 1B, 2C, and 3, the floor structure according to the present embodiment is formed by arranging a plurality of structural steel materials 100 in parallel. The floor structure is used for the structural framework of an erected construction, for example, of a building such as a commercial building or house. A top flange 104 of any one structural steel material 100 is placed so as to cover a top surface of a bottom flange 106 of another structural steel material 100 that is placed adjacently thereto.

As is shown in FIGS. 1A and 2A, the structural steel materials 100 according to the present embodiment are provided with a web 102, a top flange 104, and a bottom flange 106. Note that in FIGS. 1A and 1B, a case is shown in which the plate thicknesses of the webs 102 and the top flanges 104 and bottom flanges 106 are the same. In contrast, in FIGS. 2A to 2C, a case is shown in which the plate thicknesses of the top flanges 104 and bottom flanges 106 are thicker than the plate thickness of the webs 102. Here, the webs 102 are an example of a supporting portion.

The structural steel materials 100 are manufactured, for example, from steel, and are manufactured by hot roll molding or cold roll molding, press molding, extrusion molding, or draw molding or the like. Accordingly, the structural steel materials 100 can be manufactured easily and manufacturing costs can be reduced. The structural steel materials 100 are an example of a structural metal component. Note that in the present embodiment, a description is given of an example in which the structural metal components are manufactured from steel, however, the present invention is not limited to this example. For example, the structural metal components may also be metal components formed from an aluminum alloy or titanium alloy or the like.

As is shown in FIG. 3, the webs 102 are elongated steel plates that are positioned perpendicularly to the installation surfaces when the structural steel materials 100 are arranged as the floor of an erected construction. The top flanges 104 extend from top end portions 102*a* of the webs 102 in parallel with the installation surfaces. The bottom flanges 106 extend from bottom end portions 102*b* of the webs 102 in parallel with the installation surfaces, and in the opposite direction from the top flanges 104.

As is shown in FIG. 3, the top flanges 104 are elongated steel plates. When the structural steel materials 100 are laid as the floor of an erected construction, the top flanges 104 extend from the top end portions 102*a* of the webs 102 in parallel with the installation surfaces so as to form horizontal top surfaces. Free end sides of the top flanges 104 form end portions 104*a* that are free relative to the top end portions 102*a* of the fixed webs 102. The end portions 104*a* are in contact with the top end portion 102*a* of the web 102 of another structural steel material 100 that is placed adjacent thereto. A top surface of the floor structure is formed with no gaps in it by laying a plurality of structural steel materials 100 in this manner.

As is shown in FIG. 3, the bottom flanges 106 are also elongated steel plates. When the structural steel materials 100 are laid as the floor of an erected construction, the bottom flanges 106 extend in the opposite direction to the top flanges 104 from the bottom end portions 102*b* of the webs 102 in parallel with the top flanges 104 so as to form horizontal bottom surfaces. Free end sides of the bottom flanges 106 form end portions 106*a* that are free relative to the bottom end portions 102*b* of the fixed webs 102. The bottom ends 106*a* are in contact with the top end portion 102*a* of the web 102 of another structural steel material 100 that is placed adjacent thereto. A top surface of the floor structure is formed with no gaps in it by arranging a plurality of structural steel materials 100 in this manner.

As is shown in FIG. 2B, the structural steel materials 100 may be stacked by stacking one structural steel material 100 on top of another structural steel material 100. A plurality of structural steel materials 1100 may be stacked on top of each other provided that they do not become deformed and provided that there is no deterioration in their structural properties. Therefore, according to the present embodiment, when the structural steel materials are being transported, a large number of structural steel materials 100 can be loaded onto the loading bed of a truck, for example, without occupying any more space than is necessary (i.e., is space saving). Namely, it is possible to increase the quantity that can be transported in a single load. As a result, transporting costs can be reduced.

Next, a description will be given of an end portion steel material that is used as an end portion of a floor structure with reference to FIGS. 4A through 4D. FIGS. 4A through 4D are side views showing the structural steel materials, end portion steel materials and the floor structure according to the present embodiment.

When a plurality of just the above described structural steel materials 100 have been laid in parallel with each other, the top flanges 104 and the bottom flanges 106 are not formed on end portions of the floor structure, and here the structure has no top surface or no bottom surface. Accordingly, end portion steel materials are laid in order to close off the floor structure. In the same way as the structural steel materials 100, the end portion steel materials are manufactured from, for example, steel, and are manufactured by roll molding or press molding or the like. The shape of the end portion steel materials is not restricted provided that it allows the end portions of the floor structure to be closed. A specific example thereof is described below.

Figure 4A:
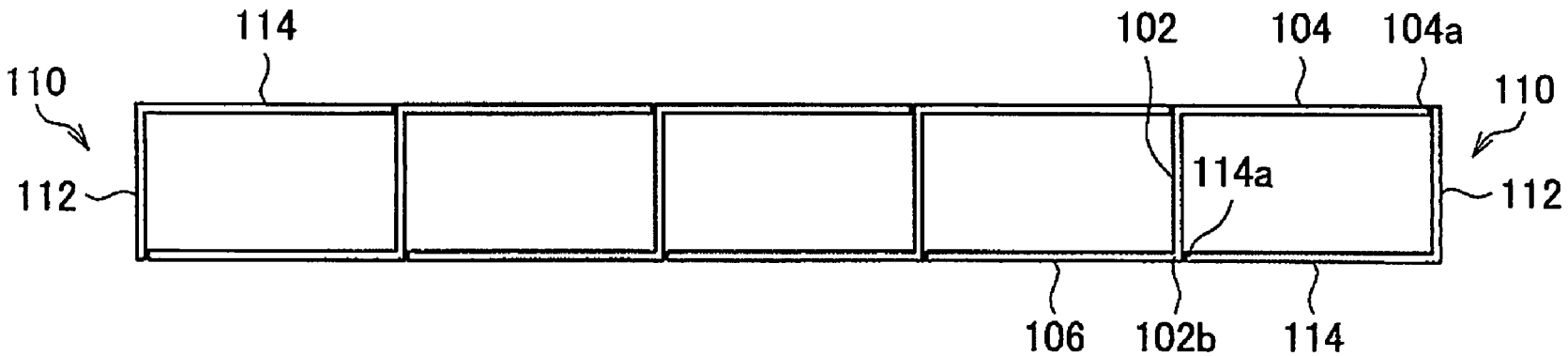
FIG. 4A is a side view showing the structural steel materials, end portion steel materials and the floor structure according to the embodiment.

As is shown in FIGS. 3 and 4A, an end portion steel material 110 has an L-shaped cross section and is formed, for example, by a web 112 and a flange 114. The web 112 is an elongated steel plate, and is positioned perpendicularly to an installation surface when the structural steel materials 100 are laid as the floor of an erected construction. The flange 114 is an elongated steel plate and extends from an end portion of the web 112 in a perpendicular direction relative to the web 112. The end portion steel material 110 is positioned such that, in the floor structure in which the plurality of structural steel materials are laid in parallel with each other, on the side thereof where a top flange 104 forms an end portion, the flange 114 of the end portion steel material 110 is placed horizontally as the bottom surface of the floor structure, and such that the flange 114 is covered by the top flange 104 of the structural steel material 100. In contrast, on the side where a bottom flange 106 forms an end portion, the flange 114 of the end portion steel material 110 is placed horizontally as the top surface of the floor structure, and such that it covers the bottom flange 106 of the structural steel material 100.

Figure 4B:
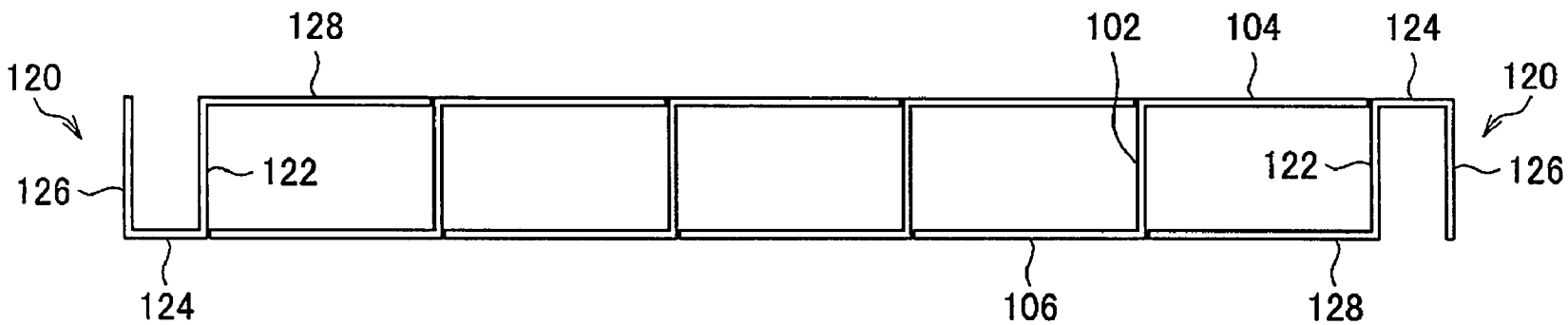
FIG. 4B is a side view showing the structural steel materials, end portion steel materials and the floor structure according to the embodiment.

Moreover, as is shown in FIG. 4B, an end portion steel material 120 is formed by a web 122, a first flange 124, an end component 126, and a second flange 128. The web 122 is an elongated steel plate, and is positioned perpendicularly when the structural steel materials 100 are laid as the floor of an erected construction. The first flange 124 is an elongated steel material and extends in one direction from an end portion of the web 122, and is placed horizontally relative to the installation surface. The end component 126 is an elongated steel material, and is positioned extending from one end portion of the first flange 124 in parallel with the web 122. The end component 126 has the same height, for example, as the web 122. The second flange 128 is an elongated steel material and extends in the opposite direction to the first flange 124 from another end portion of the web 122, and is placed horizontally relative to the installation surface. A cross section of the web 122, the first flange 124, and the end component 126 form a flat-end U shape. By employing this structure, the end portion steel material 120 has the function of joining with the beams of the structural framework of the erected construction that support the floor structure.

In the same way as for the above described end portion steel material 110, the end portion steel material 120 is also positioned such that, in the portion of the floor structure where a top flange 104 of a structural steel material forms an end portion, the second flange 128 of the end portion steel material 120 is placed horizontally as the bottom surface of the floor structure, and such that the second flange 128 is covered by the top flange 104 of the structural steel material 100. In contrast, in the portion where a bottom flange 106 forms an end portion, the second flange 128 of the end portion steel material 120 is placed horizontally as the top surface of the floor structure, and such that it covers the bottom flange 106 of the structural steel material 100.

Figure 4C:
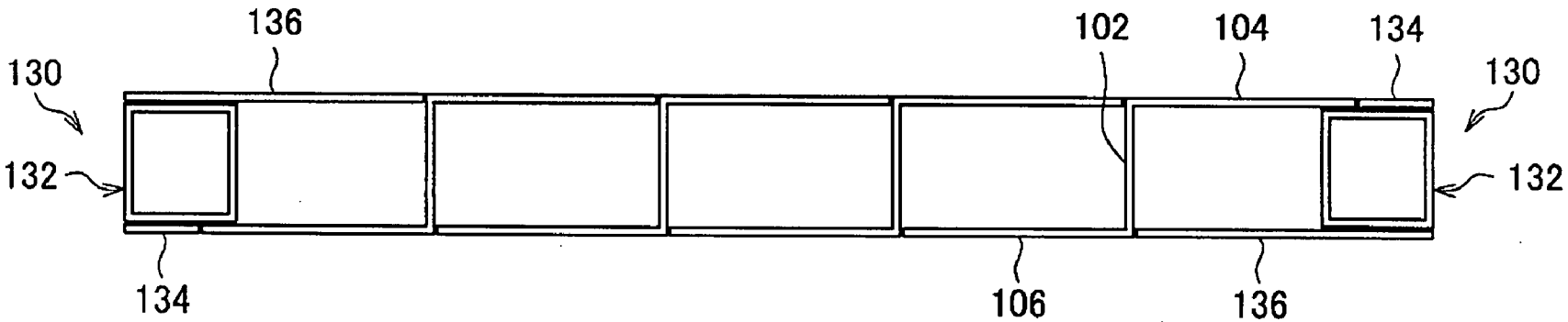
FIG. 4C is a side view showing the structural steel materials, end portion steel materials and the floor structure according to the embodiment.

Moreover, as is shown in FIG. 4C, an end portion steel material 130 may also be formed from shaped steel 132 having a box-shaped cross-sectional configuration, and steel plates 134 and 136 having a flat plate shape. The height of the shaped steel 132 when it is placed in position as a structural component of the floor structure is substantially the same as the internal dimension between the top flange 104 and the bottom flange 106 of the structural steel material 100. The steel plates 134 and 136 are elongated steel materials, and the steel plate 134 has a narrower width than the steel plate 136. The shaped steel 132, the steel plate 134, and the steel plate 136 may be formed into a single unit by welding or the like.

The end portion steel materials 130 are arranged such that, in that portion of a floor structure in which a plurality of structural steel materials 100 have been arranged in parallel with each other where the top flange 104 forms an end portion, the steel plate 136 is placed horizontally as the bottom surface of the floor structure, and the shaped steel 132 is placed above the steel plate 136 as the end portion of the floor structure. In addition, the steel plate 134 is positioned so as to be in contact with the top flange 104 of a structural steel material 100 above the shaped steel 132. In contrast, in that portion where the bottom flange 106 of a structural steel material 100 forms an end portion, the steel plate 134 is placed horizontally as the bottom surface of the floor structure, and the shaped steel 132 is placed above the steel plate 134 as the end portion of the floor structure. In addition, the steel plate 136 is positioned so as to be in contact with the top flange 104 of a structural steel material 100 above the shaped steel 132.

Note that a description has been given of a case in which the above described end portion steel materials 130 are provided with a narrow-width steel plate 134, however, the present invention is not limited to this structure. It is also possible to not provide the steel plate 134, and instead to place the shaped steel 132 between the steel plate 136 and the top flange 104 or the bottom flange 106 of the structural steel materials 100.

Figure 4D:
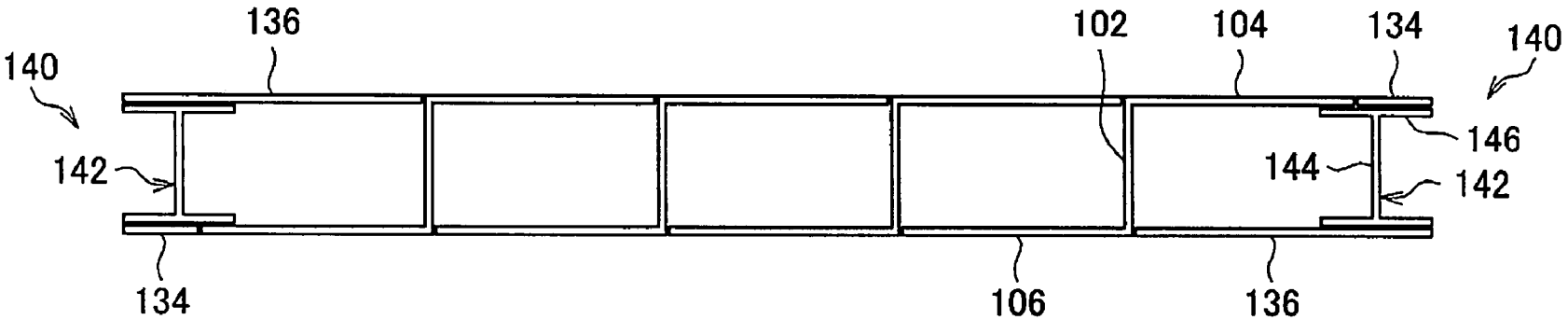
FIG. 4D is a side view showing the structural steel materials, end portion steel materials and the floor structure according to the embodiment.

Furthermore, as is shown in FIG. 4D, it is also possible for an end portion steel material 140 to be formed that uses H-shaped steel 142 which has an H-shaped cross section as a structural component instead of the shaped steel 132 of the above described end portion steel materials 130. General H-shaped steel can be used for the H-shaped steel 142, and this H-shaped steel is formed by a web 142, and two mutually parallel flanges 146. The structure of the steel plates 134 and 136 and also the placement of the H-shaped steel 142 are the same as for the above described end portion steel material 130, therefore, a detailed description thereof is omitted.

Figure 5:
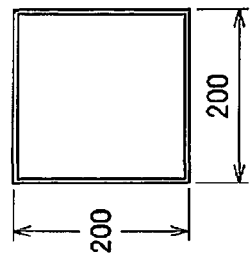
FIG. 5 is a table showing characteristics of the structural steel material according to the embodiment.
Figure 5:
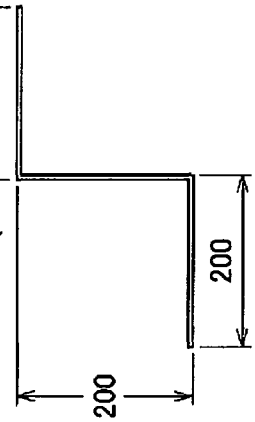
Figure 5:
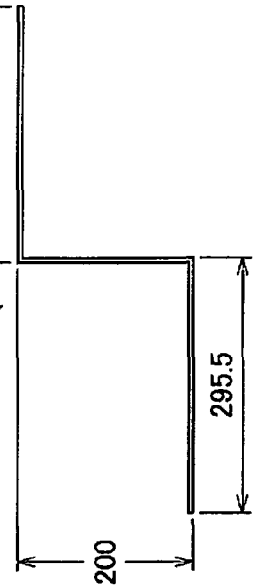

Next, the structural properties of the structural steel material 100 according to the present embodiment will be described. FIG. 5 is a table showing characteristics of the structural steel material 100 according to the present embodiment and of shaped steel according to the conventional technology.

Here, the shaped steel of the conventional technology that is used for a comparison is the box-shaped steel material disclosed in Patent document 4. A plurality of these box-shaped steel materials 10 are arranged in parallel so as to form a floor structure. The box-shaped steel materials 10 of this comparison have both a width and height of 200 mm, and a thickness of 4.5 mm. The structural steel material 100 according to the present embodiment which is shown in column (b) in FIG. 5 has the following dimensions. Namely, the height of the web 102 is 200 mm, the lengths of the top flange 104 and the bottom flange 106 are 200 mm, and the thickness is 4.5 mm. The structural steel material 100 according to the present embodiment which is shown in column (c) in FIG. 5 has the following dimensions. Namely, the height of the web 102 is 200 mm, the lengths of the top flange 104 and the bottom flange 106 are 295.5 mm, and the thickness is 4.5 mm.

The lengths of the web 102, the top flange 104 and the bottom flange 106 of the structural steel material 100 according to the present embodiment shown in column (b) in FIG. 5 are the same as the width and height of the box-shaped steel materials 10 used for this comparison. At this time, the structural steel materials 100 of the present embodiment have a cross-sectional area A which is substantially ¾ths that of the box-shaped steel materials 10, enabling a reduction to be achieved in the quantity of steel material that is used. Moreover, the flexural rigidity (a geometrical moment of inertia I) per unit surface area I/A thereof is 1.16 times the flexural rigidity (a geometrical moment of inertia I) per unit surface area I/A of the box-shaped steel materials 10.

Furthermore, the length of the web 102 of the structural steel material 100 according to the present embodiment shown in column (c) in FIG. 5 is the same as the height of the box-shaped steel materials 10. In addition, the lengths of the top flange 104 and the bottom flange 106 are set such that the structural steel materials 100 of the present embodiment have a cross-sectional area which is the same as that of the box-shaped steel materials 10. At this time, because the two cross-sectional areas are the same, the quantity of steel that is used is the same, however, the flexural rigidity (the geometrical moment of inertia I) per unit surface area I/A of the structural steel materials 100 is 1.267 times the flexural rigidity (the geometrical moment of inertia I) per unit surface area I/A of the box-shaped steel materials 10.

As a result of the above, according to the present embodiment, compared with a floor structure in which conventional box-shaped steel materials 10 are laid, a floor structure in which a plurality of structural steel materials 100 are laid has improved structural properties and is a more lightweight structure.

Figure 6:
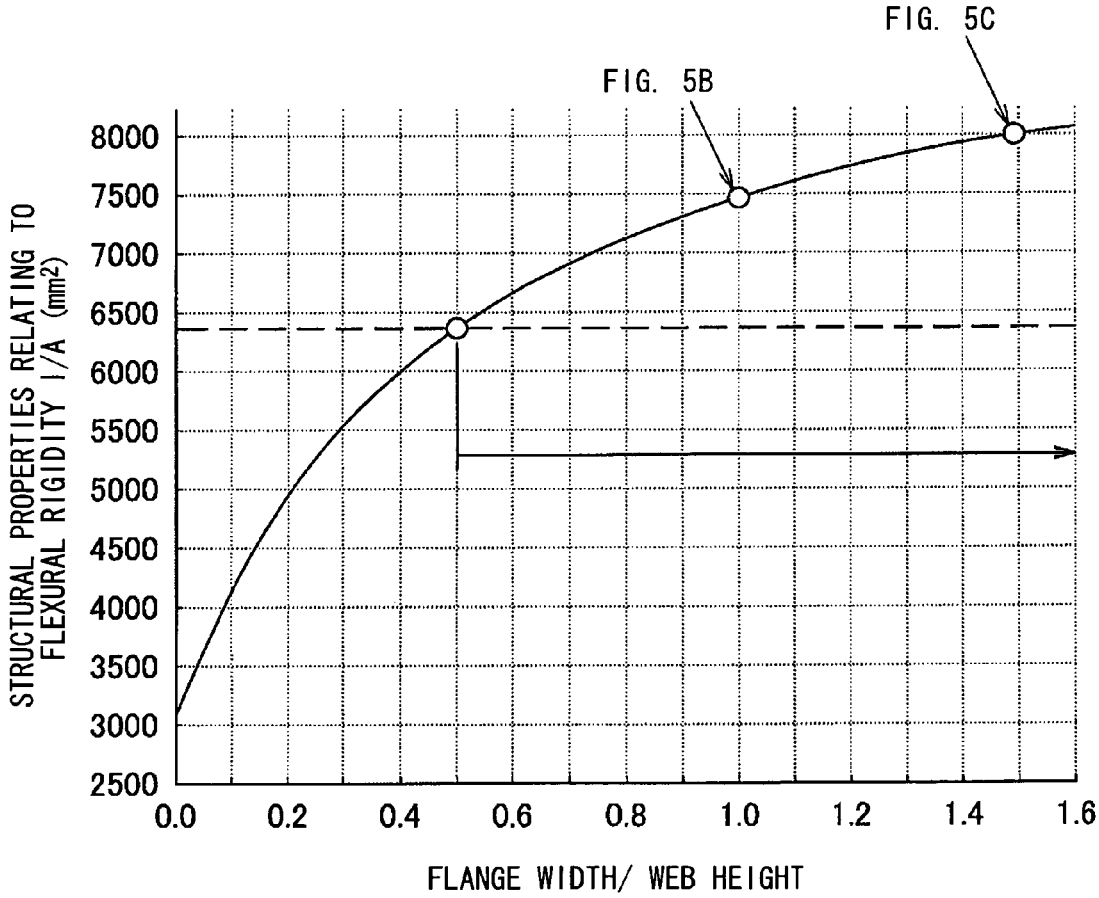
FIG. 6 is a graph showing a relationship between structural properties relating to flexural rigidity and the flange width and web height of the structural steel material according to the embodiment.

Next, a description will be given of an optimum width L for the top flange 104 and bottom flange 106 according to the present embodiment with reference to FIG. 6. FIG. 6 is a graph showing a relationship between structural properties relating to flexural rigidity and the flange width and web height of the structural steel material 100 according to the present embodiment.

The range of the flange width L is fixed in consideration of bending of the flange, the occurrence of localized buckling, and economic efficiency. Namely, it is more economical if the flange width is longer, however, if flange bending and the occurrence of localized buckling are taken into account, then desirable maximum and minimum values, and also a more desirable maximum value for the flange width can be decided.

Firstly, a desirable maximum value for a flange width L will be described. If the length of the flange width L is increased, then it is possible to decrease the number structural steel materials 100 that are laid to form a floor structure, and the total number of webs can also be decreased. However, if the length of the flange width L is too long, then bending 6 of the top flange 104 of the structural steel materials 100 (see FIG. 1B) becomes a problem.

If the plate thickness of the top flange 104 is taken as t, and if it is assumed that a uniformly distributed load w=2900 N/m$^2$ is acting on the top flange 104 (based on the loading capacity permitted in a business premises according to Enforcement Ordinance of Construction Standards Law—Article 85), then if the maximum bending δ max of the structural steel materials 100 is set at not more than L/300, by means of the following calculation, a maximum value of the flange width L can be found as a function of t expressed by Formula (4) below.

$$\delta=5wL^4/(384EI)\leqq L/300 \quad (1)$$

Here, E is Young's modulus. Because w=2900 N/m$^2$, if the load width is taken as 1 m, and unit conversion is performed, then the following is obtained.

$$w=2.9\text{N/mm} \quad (2)$$

In the case of the geometrical moment of inertia as well, if a load width b is taken as 1000 mm, the following is obtained.

$$I=bt^3/12=1000t^3/12 \quad (3)$$

If these Formulas (2) and (3) are substituted into Formula (1), and it is taken that E=205000 N/mm$^2$, then the following is obtained.

$$L/t\leqq 115 \quad (4)$$

Accordingly, a desirable maximum value for the flange width L is 115 t, namely, 115 times the plate thickness t of the top flange 104.

In the above calculations, a maximum value was calculated for the flange width L based on the bending of the structural steel materials 100, however, it is necessary to assume a case in which a large out-of-plane bending force is acting on the floor surface of the floor structure, and to evaluate the localized buckling strength of the top flange 104.

Therefore, because evaluation is possible provided that the structure resembles a plate material, the maximum value of the flange width L can be calculated by invoking Formula (5) below in order to suppress the occurrence of buckling in the plate material.

$$L/t\leqq 740/\sqrt{f} \quad (5)$$

Here, f is an acting force that is acting on the top flange 104 in a perpendicular direction relative to the surface of the top flange 104, and is set at a value that allows for a safety factor of 3 times a value of 235 N/mm$^2$ for the design standard strength F of a typical steel material SS400. Therefore, if f is substituted into Formula (5), the following is obtained.

$$L/t\leqq 740/\sqrt{135/3}\approx 84 \quad (6)$$

Accordingly, a more desirable value for the flange width L is not more than 84 t, namely, not more than 84 times the plate thickness t of the top flange 104. Note that it is possible to appropriately establish (for example, to further extend) the width of the flange width L by providing a rib on the flange. Here, this rib is effective in preventing bending and/or localized buckling, and has a structure that, for example, makes it possible to restrict any bending occurring in the flange to L/300 or less, and that can suppress the occurrence of any localized buckling.

Next, the minimum value of the flange width L will be described. If the flange width L is shortened, it becomes difficult for problems to occur in rigidity (i.e., bending) and strength (i.e., localized buckling), so that what has to be considered when deciding a desirable minimum value for the flange width L is economic efficiency.

Namely, the economic efficiency of the structural steel materials 100 is decided by the relationship thereof with the flexural rigidity (I/A) per unit surface area. FIG. 6 is a graph showing a relationship between the flexural rigidity (I/A) per unit area of the structural steel materials 100 of the present embodiment and a ratio of the flange width relative to the web height. The two points shown in FIG. 6 are where data for the ratios of the flange width relative to the web height and the flexural rigidities (I/A) of the present embodiment shown in the columns (b) and (c) in FIG. 5 have been plotted. In addition, the I/A of the box-shaped steel materials 10 used for the conventional technology is 6374 mm$^2$, and is the value shown by the broken line in FIG. 6. It is desirable for the structural steel materials 100 to have a value that is not less than the I/A of the box-shaped steel materials 10. Accordingly, as can be seen from the graph shown in FIG. 6, a desirable minimum value for the flange width L is ½ the web height.

As a result of the above, the range of the flange width L is desirably not less than ½ the web height, and not more than 115 times the plate thickness of the top flange 104, and more desirably not more than 84 times the plate thickness of the top flange 104.

According to the first embodiment of the present invention, by forming a floor structure by laying in parallel with each other adjacent structural steel materials 100 that are each provided with a web 102, a top flange 104, and a bottom flange 106, it is possible to form a floor structure that is more lightweight than a floor structure which is formed by laying the box-shaped steel materials 10 that are used in the conventional technology, and it is also possible to obtain improved structural properties. Moreover, because it is possible to stack a plurality of the structural steel materials 100, space can be saved during transportation thereby enabling an improvement in the steel material transporting efficiency to be achieved.

Second Embodiment

Figure 7A:
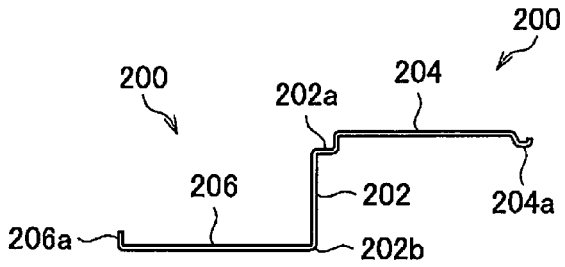
FIG. 7A is a side view showing a structural steel material according to a second embodiment of the present invention.
Figure 7B:
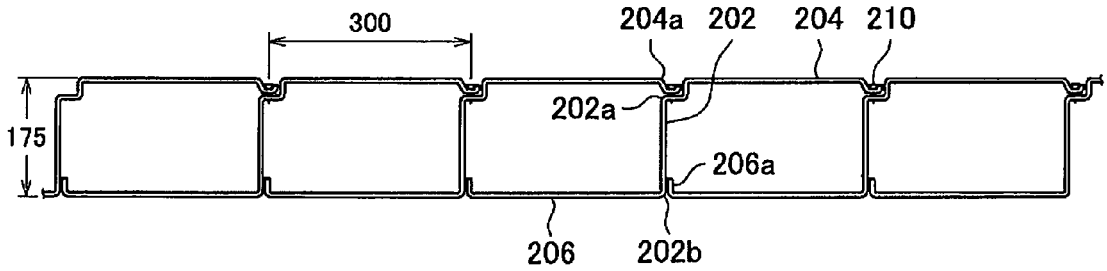
FIG. 7B is a side view showing a floor structure according to the embodiment.

Next, a structural steel material and floor structure according to a second embodiment of the present invention will be described. FIGS. 7A and 7B are side views showing the structural steel material and floor structure according to the present embodiment.

As is shown in FIG. 7B, the floor structure according to the present embodiment is formed by laying a plurality of structural steel materials 200 in parallel with each other. Moreover, as is shown in FIG. 7A, the structural steel materials 200 according to the present embodiment are provided with a web 202, a top flange 204, and a bottom flange 206. A floor structure is formed in which a top flange 204 of any one structural steel material 200 is placed so as to cover a top surface of a bottom flange 206 of another structural steel material 200 that is placed adjacently thereto. FIG. 7B shows a case in which the flange width is 300 mm, and the web height is 175 mm, however, the present embodiment is not limited to this example.

The main structures of the web 202, the top flange 204 and the bottom flange 206 according to the present embodiment are the same as those of the above described first embodiment, therefore, a detailed description thereof is omitted. As is shown in FIGS. 7A and 7B, in the present embodiment there are further provided a joining portion 202*a* that is formed on a top end portion of the web 202, and a projecting portion 204*a* that is formed on an end portion of the top flange 204. The joining portion 202*a* has a surface that is at a lower position than the top surface of the top flange 204, and is parallel with the top flange 204. The projecting portion 204*a* has a groove shape that is hollowed out below the top flange 204. When any one structural steel material 200 is joined to another adjacent structural steel material 200, as is shown in FIG. 7B, the projecting portion 204*a* is mounted in contact with the joining portion 202*a*, and these two are then joined together by drill screws 210. The joining portion 202*a* and the projecting portion 204*a* that have been screwed together are formed at a position below the top flange 204. Accordingly, no portion protrudes above the top surface of the top flange 204, and it is possible to provide a floor structure that is tightly fit together and has a flat surface.

Here, the drill screws 210 are an example of a fixing tool, however, the present embodiment is not limited to this example and it is also possible to use semi-finished bolts, high strength bolts, rivets, caulking, welding, or bonding or the like as a fixing tool. Moreover, in the structural steel materials 200 of the present embodiment, a bent portion 206*a* is formed on an end portion of the bottom flange 206. The bent portion 206*a* has a surface that is parallel with the web 202 and extends from the bottom flange 206 in a perpendicular direction relative thereto. When a floor structure is formed by laying a plurality of structural steel materials 200 in parallel with each other, the bent portions 206*a* are in contact with a bottom end portion 202*b* of the web 202 of the adjacent structural steel material 200.

Next, a description will be given of a construction technique for constructing a floor structure according to a second embodiment of the present invention. FIGS. 8A to 8D are side views showing a construction technique for the floor structure of the present embodiment.

Figure 8A:
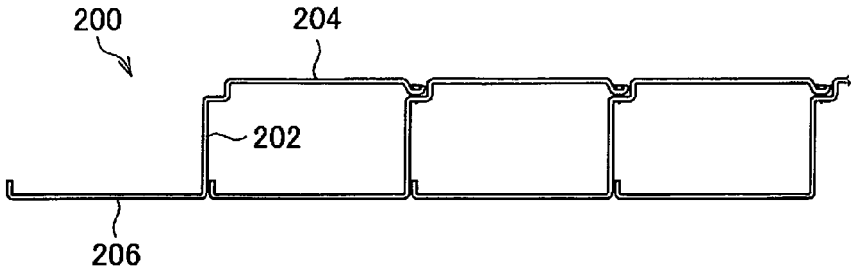
FIG. 8A is a side view showing a construction technique for the floor structure of the same embodiment.
Figure 8B:
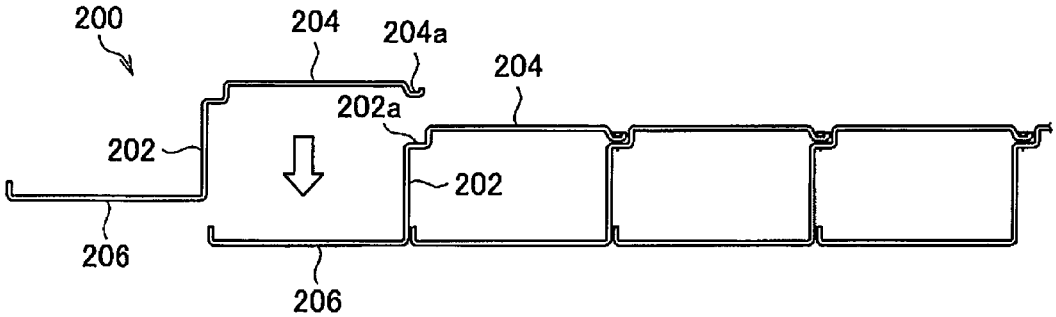
FIG. 8B is a side view showing a construction technique for the floor structure of the same embodiment.
Figure 8C:
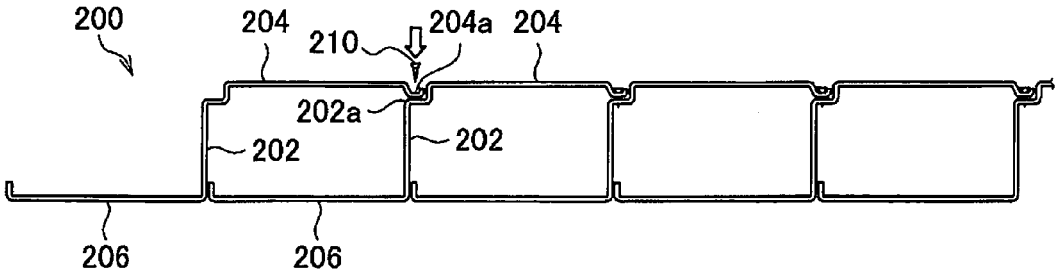
FIG. 8C is a side view showing a construction technique for the floor structure of the same embodiment.
Figure 8D:
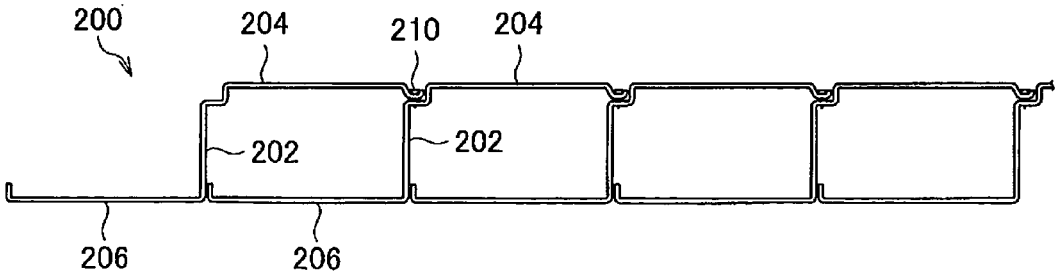
FIG. 8D is a side view showing a construction technique for the floor structure of the same embodiment.

FIG. 8A shows a state midway through a process to construct a floor structure, and a bottom flange 206 is exposed at an end portion thereof. Next, as is shown in FIG. 8B, another new structural steel material 200 is readied for laying. At this time, the top flange 204 of the structural steel material 200 currently being laid is positioned so as to cover the top portion of the bottom flange 206 of the structural steel material 200 that was laid previously. Furthermore, the structural steel material 200 is laid such that the projecting portion 204*a* of the top flange 204 fits in the joining portion 202*a*. Next, as is shown in FIG. 8C, drill screws 210 are screwed from the top portion of the projecting portion 204*a* towards the joining portion 202*a*, thereby joining together the two structural steel materials 200. FIG. 8D shows a state in which a newly laid structural steel material 200 is joined to the adjacent structural steel material 200.

As has been described above, according to the floor structure and structural steel materials 200 of the present embodiment, because a plurality of structural steel materials 200 are joined together in an integrated unit by means of the drill screws 210 or the like, the structural steel materials 200 are prevented from moving independently within the plane of the floor structure. Accordingly, it is possible to increase the in-plane shear rigidity of the floor structure.

Third Embodiment

Figure 9A:
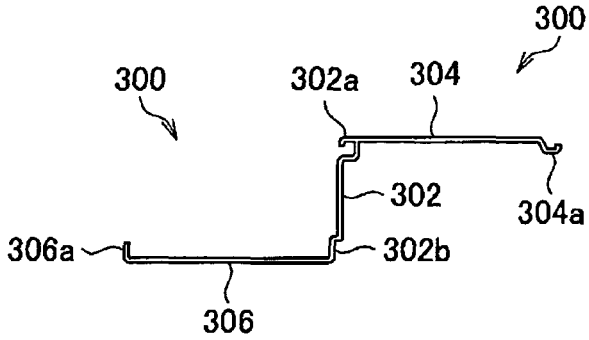
FIG. 9A is a side view showing a structural steel material according to a third embodiment of the present invention.
Figure 9B:
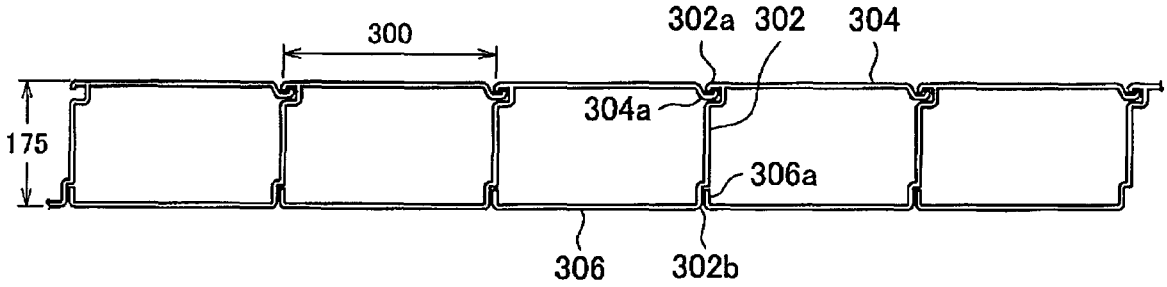
FIG. 9B is a side view showing a floor structure according to the embodiment.
Figure 10:
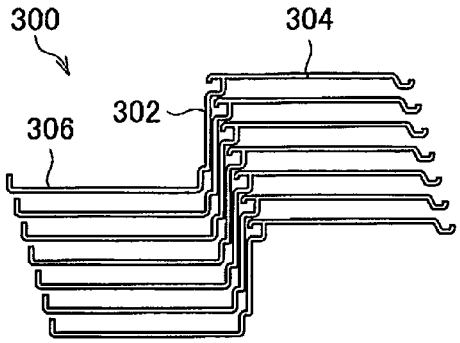
FIG. 10 is a side view showing a state in which the structural steel materials according to the embodiment are stacked.

Next, a structural steel material and floor structure according to a third embodiment of the present invention will be described. FIGS. 9A and 9B are side views showing the structural steel material and floor structure according to the present embodiment. FIG. 10 is a side view showing a state in which the structural steel materials according to the same embodiment are stacked.

As is shown in FIG. 9B, the floor structure according to the present embodiment is formed by laying a plurality of structural steel materials 300 in parallel with and also adjacent to each other. Moreover, as is shown in FIG. 9A, the structural steel materials 300 according to the present embodiment are provided with a web 302, a top flange 304, and a bottom flange 306. A floor structure is formed in which a top flange 304 of any one structural steel material 300 is placed so as to cover a top surface of a bottom flange 306 of another structural steel material 300 that is placed adjacently thereto. FIG. 9B shows a case in which the flange width is 300 mm, and the web height is 175 mm, however, the present embodiment is not limited to this example.

The main structures of the web 302, the top flange 304 and the bottom flange 306 according to the present embodiment are the same as those of the above described first embodiment, therefore, a detailed description thereof is omitted. As is shown in FIGS. 9A and 9B, in the present embodiment there are further provided a fitting portion 302*a* that is formed on a top end portion of the web 302, and an engaging portion 304*a* that is formed on an end portion of the top flange 304. A cross section of the fitting portion 302*a* in the joining portion between the top flange 304 and the top end portion of the web 302 is formed in a C shape. The engaging portion 304*a* has a groove shape that is hollowed out below the top flange 304. When any one structural steel material 300 is joined to another adjacent structural steel material 300, as is shown in FIG. 9B, the engaging portion 304*a* is fitted onto the top of the fitting portion 302*a*, and is thereby joined thereto. The method used for this fitting is the same as in the construction technique of the fourth embodiment of the present invention and a description of this embodiment is therefore omitted.

Moreover, in the structural steel materials 300 of the present embodiment, a bent portion 306*a* is formed on an end portion of the bottom flange 306. The bent portion 306*a* has a surface that is parallel with the web 302 and extends from the bottom flange 306 in a perpendicular direction relative thereto. A bent portion 302*b* is also formed on a bottom end portion of the web 302. The bent portion 302*b* is bent towards the distal end side of the bottom flange 306 by the distance of the plate thickness thereof, and has a surface that is parallel with the web 302. When a floor structure is formed by laying a plurality of structural steel materials 300 in parallel with each other, the bent portions 306*a* of the bottom flanges 306 are in contact with the bent portions 302*b* on the bottom end of the web 302 of the adjacent structural steel material 300.

Because a plurality of the structural steel materials 300 according to the present embodiment are formed into a single unit so as to form a floor structure with the fitting portions 302*a* and the engaging portions 304*a* being fitted together, it is easy to position the respective structural steel materials 300 when this floor structure is being constructed. As a result, on-site workability is facilitated.

Moreover, because the fitting portions 302*a* and the engaging portions 304*a* are fitted together in this floor structure that is constructed using the structural steel materials 300 according to the present embodiment, the structural steel materials 300 are prevented by friction force from moving independently within the plane of the floor structure. Accordingly, it is possible to raise the in-plane shear rigidity of the floor structure.

Note that, as is shown in FIG. 10, it is also possible to stack the structural steel materials 300 according to the present embodiment in the same way as the structural steel materials according to the first embodiment. As a result, when the structural steel materials are being transported, a large number of structural steel materials 300 can be loaded onto the loading bed of a truck, for example, without occupying any more space than is necessary (i.e., is space saving). Namely, it is possible to increase the quantity that can be transported in a single load. As a result, transporting costs can be reduced.

Fourth Embodiment

Figure 11A:
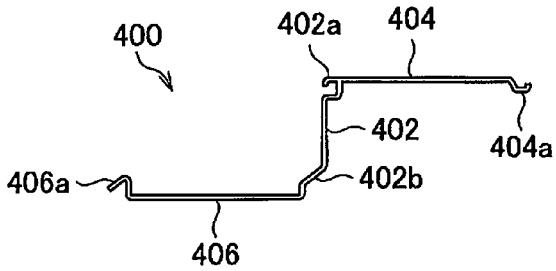
FIG. 11A is a side view showing a structural steel material according to a fourth embodiment of the present invention.
Figure 11B:
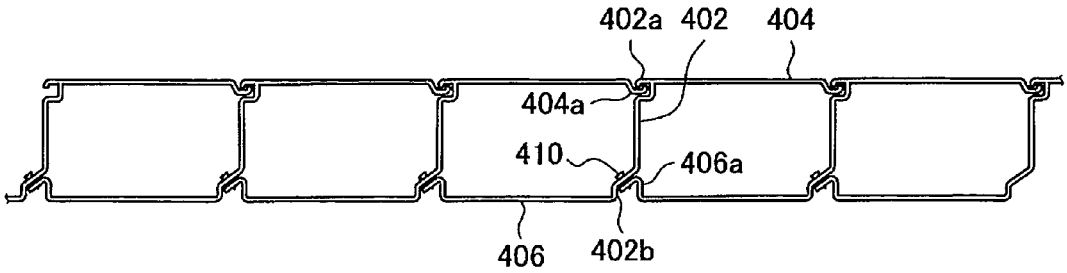
FIG. 11B is a side view showing a floor structure according to the embodiment.

Next, a structural steel material and floor structure according to a fourth embodiment of the present invention will be described. FIGS. 11A and 11B are side views showing the structural steel material and floor structure according to the fourth embodiment.

As is shown in FIG. 11B, the floor structure according to the present embodiment is formed by laying a plurality of structural steel materials 400 in parallel with and adjacent to each other. Moreover, as is shown in FIG. 11A, the structural steel materials 400 according to the present embodiment are provided with a web 402, a top flange 404, and a bottom flange 406. A floor structure is formed in which a top flange 404 of any one structural steel material 400 is placed so as to cover a top surface of a bottom flange 406 of another structural steel material 400 that is placed adjacently thereto.

The main structures of the web 402, the top flange 404 and the bottom flange 406 according to the present embodiment are the same as those of the above described first embodiment, therefore, a detailed description thereof is omitted. As is shown in FIGS. 11A and 11B, in the present embodiment there are further provided a fitting portion 402*a* that is formed on a top end portion of the web 402, and an engaging portion 404*a* that is formed on an end portion of the top flange 404. A cross section of the fitting portion 402*a* in the joining portion between the top flange 404 and the top end portion of the web 402 is formed in a C shape. The engaging portion 404*a* has a groove shape that is hollowed out below the top flange 404. When any one structural steel material 400 is joined to another adjacent structural steel material 400, as is shown in FIG. 9B, the engaging portion 404*a* is fitted onto the top of the fitting portion 402*a*, and is thereby joined thereto.

Furthermore, in the structural steel materials 400 of the present embodiment, a bent portion 406*a* is formed on an end portion of the bottom flange 406. The bent portion 406*a* has a surface that is parallel with the web 402 and extends from the bottom flange 406 in a perpendicular direction relative thereto, and also has a sloping surface whose distal end extends downwards. A sloping portion 402*b* is also formed on a bottom end portion of the web 402. The sloping portion 402*b* is bent from the web 402 towards the distal end side of the bottom flange 406, and has a sloping surface that slopes at the same angle as the aforementioned sloping surface of the bent portion 406*a*. In a floor structure in which a plurality of structural steel materials 400 are laid in parallel with each other, the bent portions 406*a* of the bottom flanges 406 are in contact with the sloping portions 402*b* on the bottom end of the web 402 of the adjacent structural steel material 400.

When any one structural steel material 400 is joined to another adjacent structural steel material 400, as is shown in FIG. 11B, the sloping portion 402*b* is mounted in contact with the bent portion 406*a*, and these two are then joined together by drill screws 410. Here, the drill screws 410 are an example of a fixing tool, however, the present embodiment is not limited to this example and it is also possible to use, for example, semi-finished bolts, high strength bolts, rivets, caulking, welding, or bonding or the like as a fixing tool.

Next, a description will be given of a construction technique for constructing a floor structure according to a fourth embodiment of the present invention. FIGS. 12A to 12E are side views showing a construction technique for the floor structure of the present embodiment.

Figure 12A:
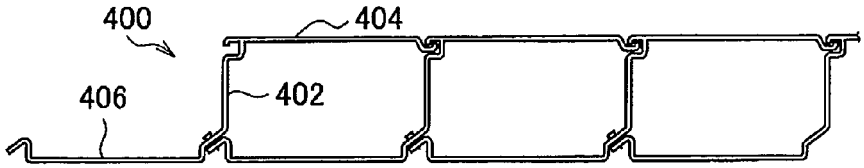
FIG. 12A is a side view showing a construction technique for the floor structure of the same embodiment.
Figure 12B:
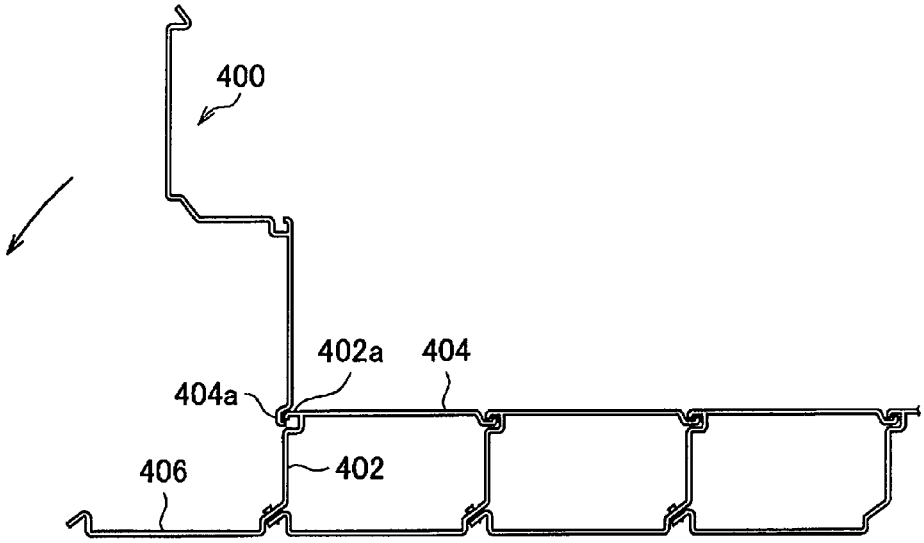
FIG. 12B is a side view showing a construction technique for the floor structure of the same embodiment.
Figure 12C:
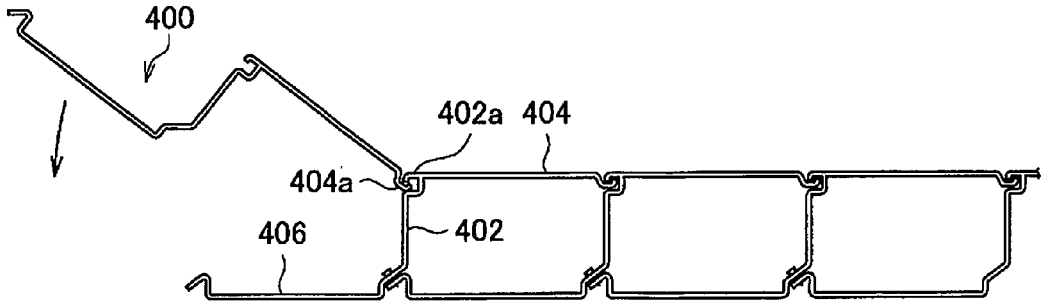
FIG. 12C is a side view showing a construction technique for the floor structure of the same embodiment.

FIG. 12A shows a state midway through a process to construct a floor structure in which a bottom flange 406 is exposed at an end portion of the floor structure. Next, as is shown in FIG. 12B, another new structural steel material 400 is readied for laying. At this time, the engaging portion 404*a* of the structural steel material 400 currently being laid is placed against the fitting portion 402*a* of the previously laid structural steel material 400. Next, as is shown in FIG. 12C, the structural steel material 400 currently being laid is rotated around the fitting portion 402*a*, thereby fitting the engaging portion 404*a* and the fitting portion 402*b* together.

Figure 12D:
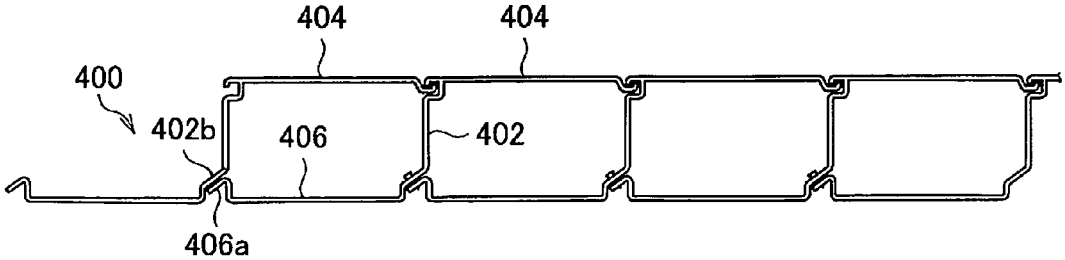
FIG. 12D is a side view showing a construction technique for the floor structure of the same embodiment.
Figure 12E:
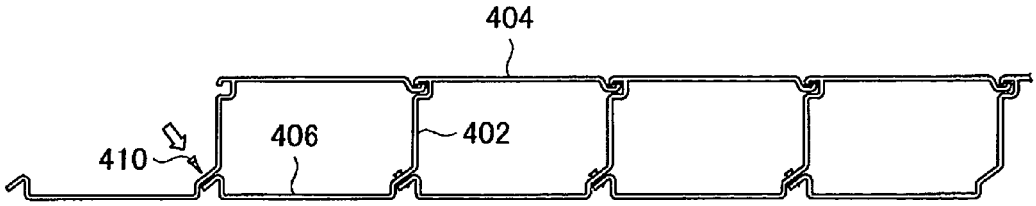
FIG. 12E is a side view showing a construction technique for the floor structure of the same embodiment.

Next, as is shown in FIG. 12D, the structural steel material 400 currently being laid is laid such that the top flange 404 covers the top portion of the bottom flange 406 of the adjacent structural steel material 400 which was laid previously. As a result, the sloping portion 402*b* of the newly laid structural steel material 400 is in contact with the top surface of the bent portion 406*a* of the previously laid structural steel material 400. Next, as is shown in FIG. 12E, drill screws 410 are screwed from the top portion of the sloping portion 402*b* towards the bent portion 406*a*, thereby joining together the two structural steel materials 400. As a result, the newly laid structural steel material 400 is joined to the adjacent structural steel material 400.

By employing the above described structure, because the structural steel materials 400 according to the present embodiment are formed into a single unit so as to form a floor structure with the fitting portions 402*a* and the engaging portions 404*a* being fitted together, it is easy to position the respective structural steel materials 400 when this floor structure is being constructed. As a result, on-site workability is facilitated.

Furthermore, according to the floor structure and structural steel materials 400 of the present embodiment, because a plurality of structural steel materials 400 are joined together in an integrated unit by means of the drill screws 410 or the like, and also because the fitting portions 402*a* and the engaging portions 404*a* are fitted together, the structural steel materials 400 are prevented by friction force from moving independently within the plane of the floor structure. Accordingly, it is possible to raise the in-plane shear rigidity of the floor structure.

Note that, in the above described third and fourth embodiments, a description is given of a case in which the fitting portions 302*a* and 402*a* and the engaging portions 304*a* and 404*a* are formed on the top flanges 304 and 404 side, however, the present invention is not limited to this. It is also possible for the fitting portions and engaging portions to be formed on the bottom flange side. In this case, conversely to the example shown in FIGS. 12A through 12E, a floor structure can be constructed by laying the structural steel materials with the engaging portion fitted into the fitting portion by lifting up the structural steel material from below.

Fifth Embodiment

Figure 13A:
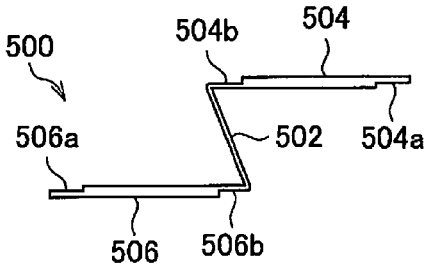
FIG. 13A is a side view showing a structural steel material according to a fifth embodiment of the present invention.
Figure 13B:
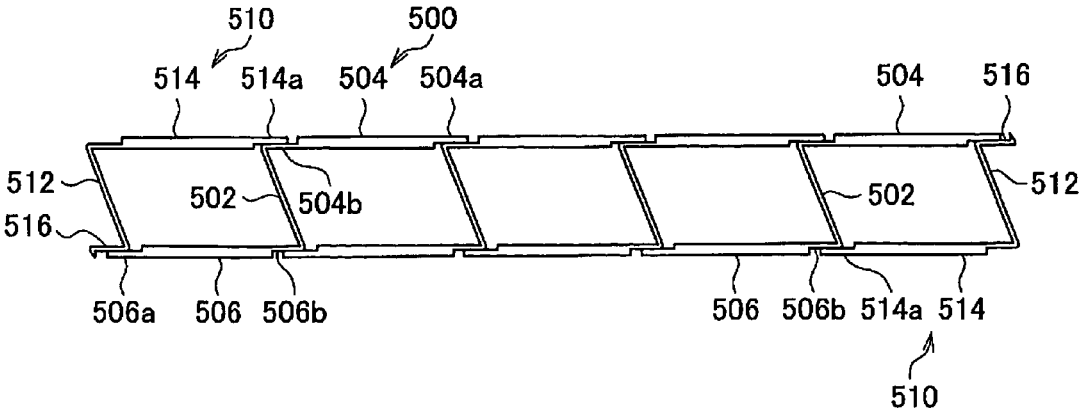
FIG. 13B is a side view showing a floor structure according to the embodiment.
Figure 14:
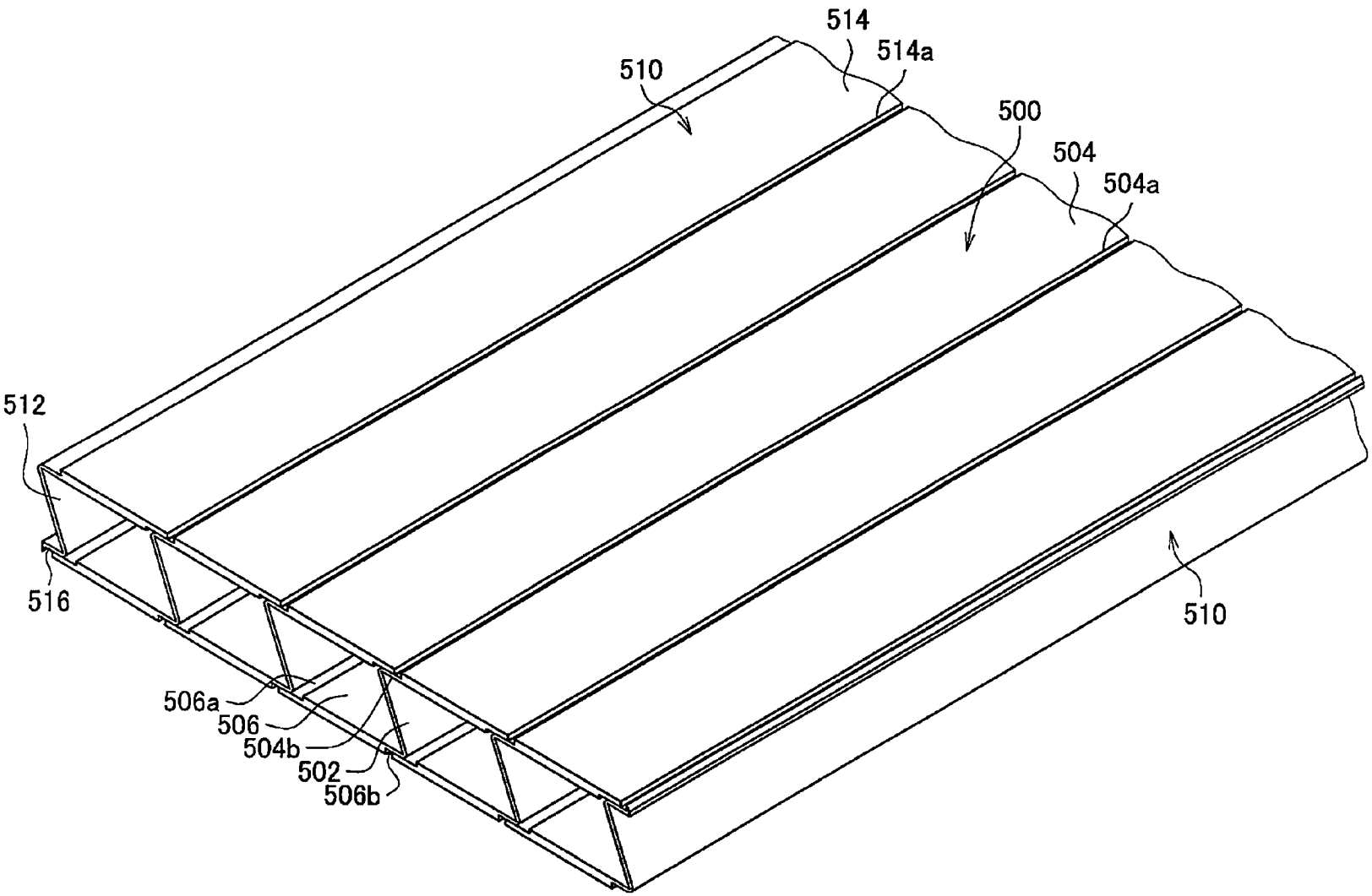
FIG. 14 is a perspective view showing the structural steel materials and the floor structure according to the embodiment.

Next, a structural steel material and floor structure according to a fifth embodiment of the present invention will be described. FIGS. 13A and 13B are side views showing the structural steel material and floor structure according to the present embodiment. FIG. 14 is a perspective view showing the structural steel material and floor structure according to the present embodiment.

As is shown in FIG. 13B and FIG. 14, the floor structure according to the present embodiment is formed by laying a plurality of structural steel materials 500 in parallel with each other. Moreover, as is shown in FIG. 13A, the structural steel materials 500 according to the present embodiment are provided with a web 502, a top flange 504, and a bottom flange 506. A floor structure is formed in which a top flange 504 of any one structural steel material 500 is placed so as to cover a top surface of a bottom flange 506 of another structural steel material 500 that is placed adjacently thereto.

The main structures of the web 502, the top flange 504 and the bottom flange 506 according to the present embodiment are the same as those of the above described first embodiment, therefore, a detailed description thereof is omitted. As is shown in FIGS. 13A and 13B, in the present embodiment, when a floor structure is being formed by laying the structural steel materials 500 in parallel with each other, the webs 502 are provided so as to be inclined relative to the installation surface. In addition, thin portions 504*a* and 506*a* that each have a thinner plate thickness are formed on the distal end sides of the bottom surface of the top flange 504 and the top surface of the bottom flange 506, and thin portions 504*b* and 506*b* are formed on the web 502 side of the top surface of the top flange 504 and the bottom surface of the bottom flange 506. These thin portions 504*a*, 504*b*, 506*a*, and 506*b* each have a surface that is parallel to the top flange 504 and the bottom flange 506. The thin portion 504*a* of the top flange 504 is in contact with the thin portion 504*b* of the top flange 504 of the adjacent structural steel material 500, and the thin portion 506*b* of the bottom flange 506 is in contact with the thin portion 506*a* of the bottom flange 506 of the adjacent structural steel material.

As is shown in FIGS. 13B and 14, an end portion steel material 510 is laid at an end portion of the floor structure. The end portion steel material 510 has a web 512, a flange 514, and a flange 516. A thin portion 514*a* having a thin plate thickness is formed at a distal end of the flange 514. When the end portion steel material 510 is placed up against a structural steel material 500 so as to cover the bottom flange 506, the thin portion 514*a* is in contact with the thin portion 504*b* of the structural steel material 500, and the flange 516 is in contact with the thin portion 506*a* of the structural steel material 500. In contrast, when the end portion steel material 510 is placed up against a structural steel material 500 such that the flange 514 is covered by the top flange 504 of the structural steel material 500, the thin portion 514*a* is in contact with the thin portion 506*b* of the structural steel material 500, and the flange 516 is in contact with the thin portion 504*a* of the structural steel material 500.

Figure 15A:
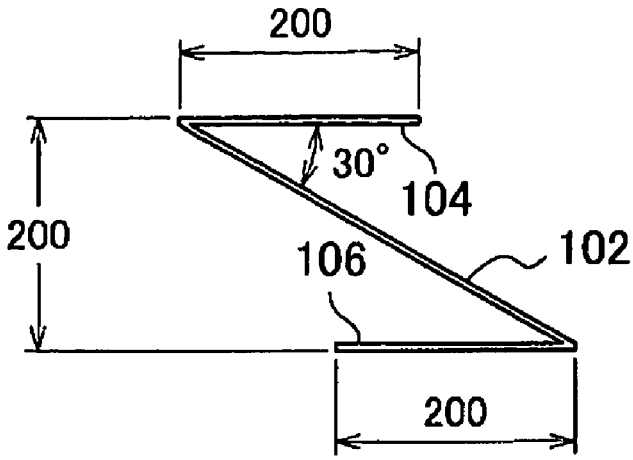
FIG. 15A is a side view showing the structural steel material according to the embodiment of the present invention.
Figure 15B:
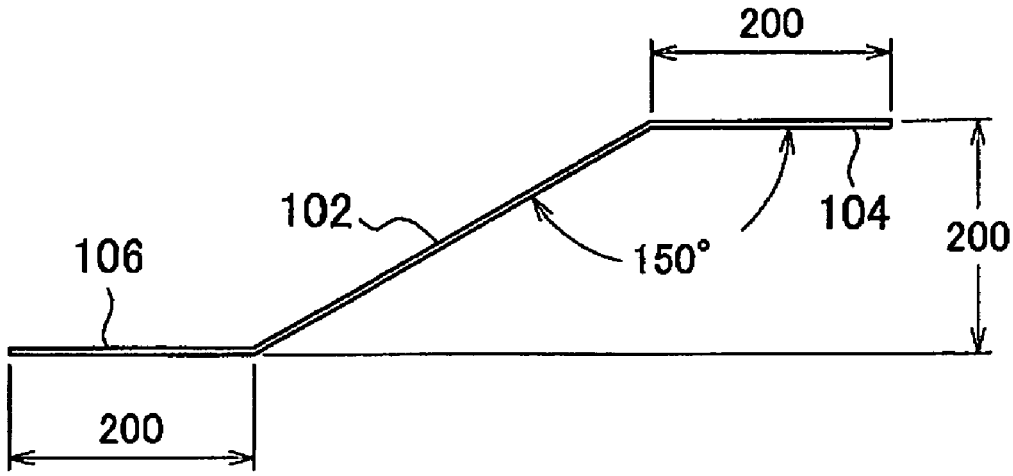
FIG. 15B is a side view showing the structural steel material according to the embodiment of the present invention.
Figure 16A:
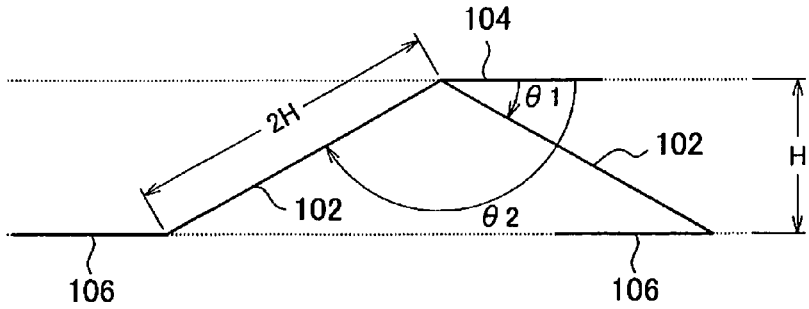
FIG. 16A is a conceptual view showing the structural steel material according to the embodiment of the present invention.
Figure 16B:
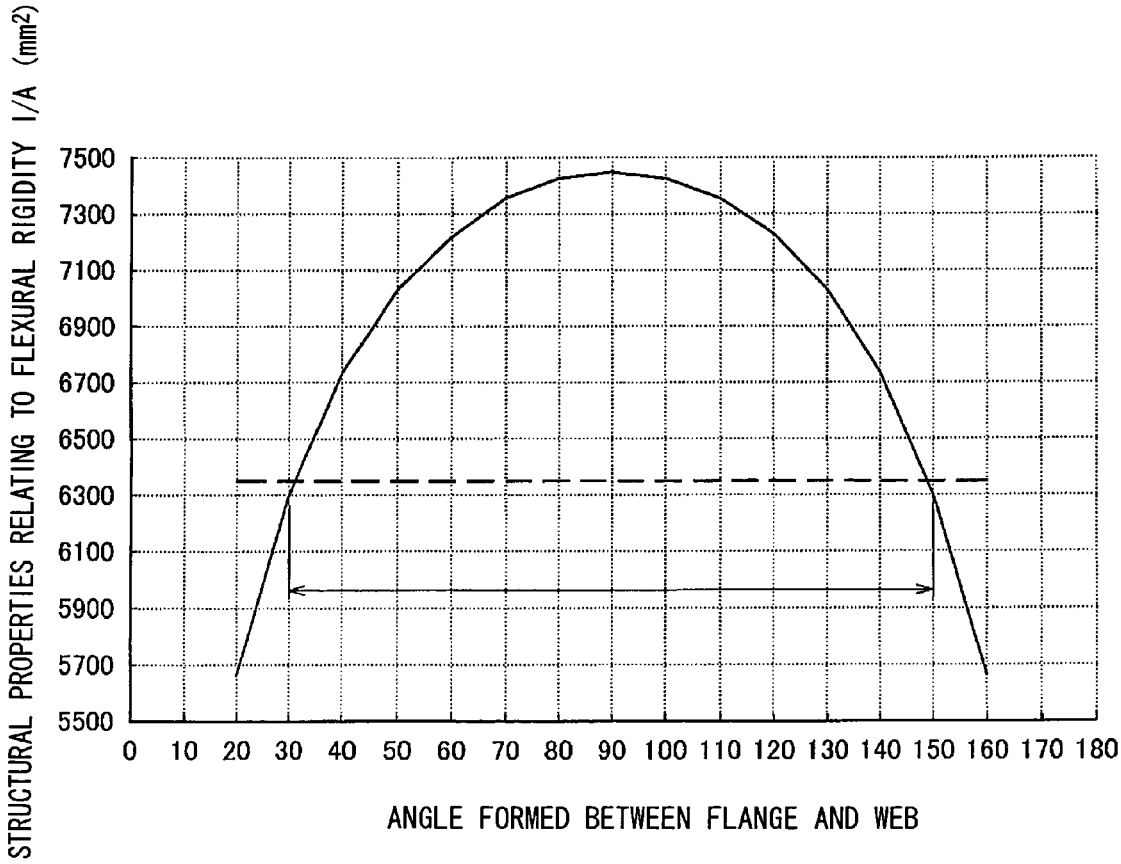
FIG. 16B is a graph showing a relationship between structural properties relating to flexural rigidity and the flange width and web height of the structural steel material according to the embodiment.

Next, a description will be given of an appropriate range for the angle of inclination of the web of the structural steel material according to the present embodiment. FIGS. 15A and 15B are side views showing the structural steel material according to the present embodiment in simplified form. FIGS. 16A and 16B are a conceptual view showing the structural steel material according to the same embodiment, and a graph showing a relationship between structural properties relating to flexural rigidity and the flange width and web height of the structural steel material according to the same embodiment.

The angle of the web 502 relative to the top flange 504 and the bottom flange 506 is within a range between an angle θ1 and an angle θ2 shown in FIG. 16A. In addition, in order to decide an appropriate range for the angle of inclination of the web 502, the plate thickness t of the web 502, the top flange 504, and the bottom flange 506 was set at 4.5 mm, the flange width was set at 200 mm, and the height H of the structural steel material 500 was set at 200 mm. The value of the geometrical moment of inertia (I/A) per unit surface area when the angle of the web 502 was changed was then examined.

The geometrical moment of inertia (I/A) per unit surface area when the angle of the web 502 was changed from 20° to 160° is shown in the graph in FIG. 16B, and is represented by a curve whose peak value is at 90°. The broken line in FIG. 16B further shows the value of the geometrical moment of inertia (I/A) per unit surface area of the box-shaped steel 10 according to the conventional technology which is shown in the column (a) in FIG. 5. As a result, it can be seen that if the angle of the web 502 is within a range between approximately 30° and 150°, then the structural steel material 500 of the present embodiment has structural properties (i.e., the geometrical moment of inertia (I/A) per unit surface area) either equivalent to or superior to box-shaped steel 10 of the same height.

Accordingly, in the present embodiment, it is desirable for the angle of the web 502 to be within a range between approximately 30° and 150°. When the angle of the web 502 is within this range, then the present embodiment is able to exhibit a higher flexural rigidity using less and lighter material compared to the conventional technology. Note that, as is shown in FIG. 16A, when the angle of the web 502 is 30° or 150°, if the web height is taken as H, then the web length is taken as 2H. Moreover, in the above described example, the plate thickness t of the web 502, the top flange 504, and the bottom flange 506 was set at 4.5 mm, the flange width was set at 200 mm, and the height H of the structural steel material 500 was set at 200 mm, however, the present embodiment is not limited to this example, and it is possible to modify these dimensions. By making the angle of the web 502 within a range between approximately 30° and 150° even if the structural dimensions (i.e., the balance) of the structural steel material 500 are changed, it is possible to obtain structural properties (i.e., the geometrical moment of inertia (I/A) per unit surface area) either equivalent to or superior to box-shaped steel 10 of the same height.

Sixth Embodiment

Next, a structural steel material and floor structure according to a sixth embodiment of the present invention will be described. FIGS. 17A to 17F are side views showing the structural steel material and floor structure according to the present embodiment.

In the above described first embodiment, a case is described in which the top flange 104 is formed extending from the top end portion of the web 102 in one direction only, and in which the bottom flange 106 is formed extending from the bottom end portion of the web 102 only in the opposite direction from the direction in which the top flange extends, however, the present invention is not limited to this example.

Figure 17A:
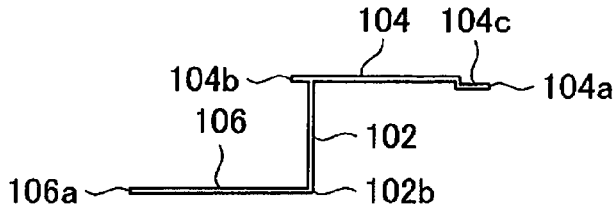
FIG. 17A is a side view showing a structural steel material according to a sixth embodiment of the present invention.

For example, as is shown in FIG. 17A, it is also possible for a protruding portion 104*b* to be formed extending from the top end portion of the web 102 in the opposite direction from the direction in which the top flange extends. At this time, a step portion 104*c* is formed on an end portion 104*a* side of the top flange 104. Moreover, as is shown in FIG. 17C, it is also possible to form a protruding portion 106*b* that extends from the bottom end portion of the web 102 in the same direction in which the top flange extends. At this time, a step portion 106*c* is formed on an end portion 106*a* side of the bottom flange 106. Moreover, as is shown in FIG. 17E, it is also possible for these protruding portions 104*b* and 106*b* to be formed respectively on the top end portion and bottom end portion of the web 102. At this time, the step portions 104*c* and 106*c* are formed respectively on the top flange 104 and the bottom flange 106.

The protruding portions 104*b* and 106*b* have the same plate thickness as the top flange 104 and the bottom flange 106. Moreover, the protruding portions 104*b* and 106*b* are formed within the same plane respectively as the top flange 104 and the bottom flange 106. The step portions 104*c* and 106*c* are formed by their respective distal ends being folded such that the sizes of their step portions are equivalent to the plate thickness of the top flange 104 and the bottom flange 106, and also have surfaces that are parallel respectively with the top flange 104 and the bottom flange 106.

Figure 17B:
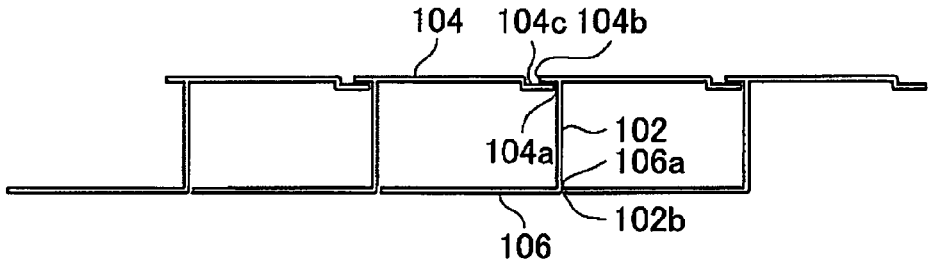
FIG. 17B is a side view showing the floor structure according to the embodiment.
Figure 17C:
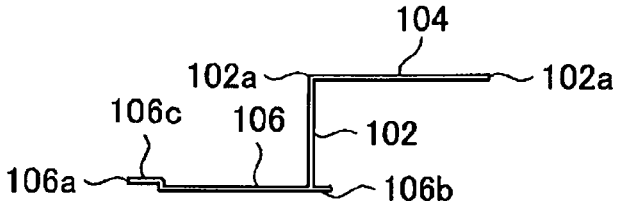
FIG. 17C is a side view showing the structural steel material according to the embodiment of the present invention.
Figure 17D:
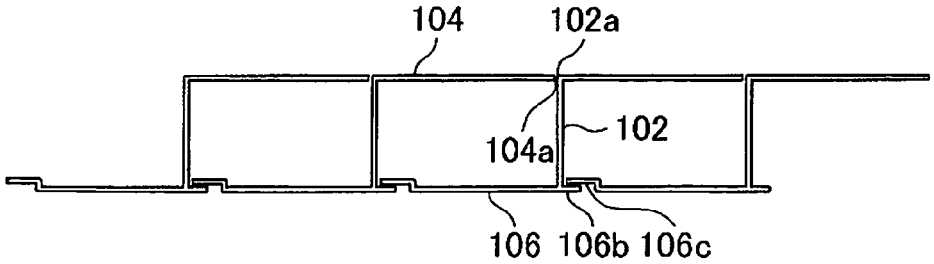
FIG. 17D is a side view showing the floor structure according to the embodiment.
Figure 17E:
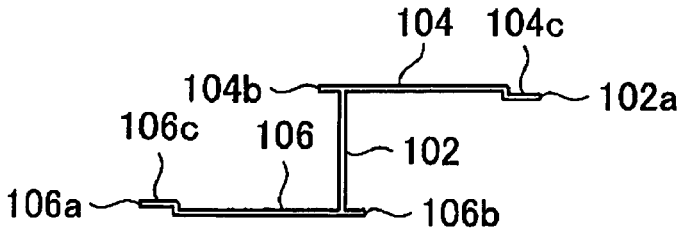
FIG. 17E is a side view showing the structural steel material according to the embodiment of the present invention.
Figure 17F:
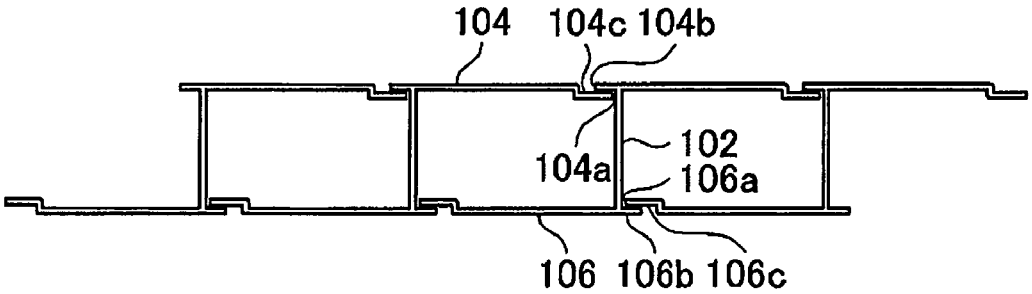
FIG. 17F is a side view showing the floor structure according to the embodiment.

In a floor structure in which a plurality of these structural steel materials 100 are laid together, as is shown in FIGS. 17B, 17D, and 17F, any one of the protruding portions 104*b* and 106*b* is in contact with a step portion 104*c* or 106*c* of the adjacent structural steel material 100. As a result of the protruding portions 104*b* and 106*b* being in contact with the step portions 104*c* and 106*c* in this manner, it is easy to position the respective structural steel materials 300 when this floor structure is being constructed. As a result, on-site workability is facilitated. In addition, because the top surfaces of the top flanges 104 of structural steel materials that are laid adjacent to each other are located on the same plane, it is possible to provide a floor structure that has a smooth surface.

Note that, in the above described embodiment, as is shown in FIGS. 17A through 17F, a case is described in which the step portions 104*c* and 106*c* are formed by bending the distal end portions of the top flange 104 and the bottom flange, however, the present invention is not limited to this. For example, it is also possible to provide these step portions by making the distal end portions of the top flange 104 and the bottom flange thinner than the other portions thereof.

Seventh Embodiment

Figure 18:
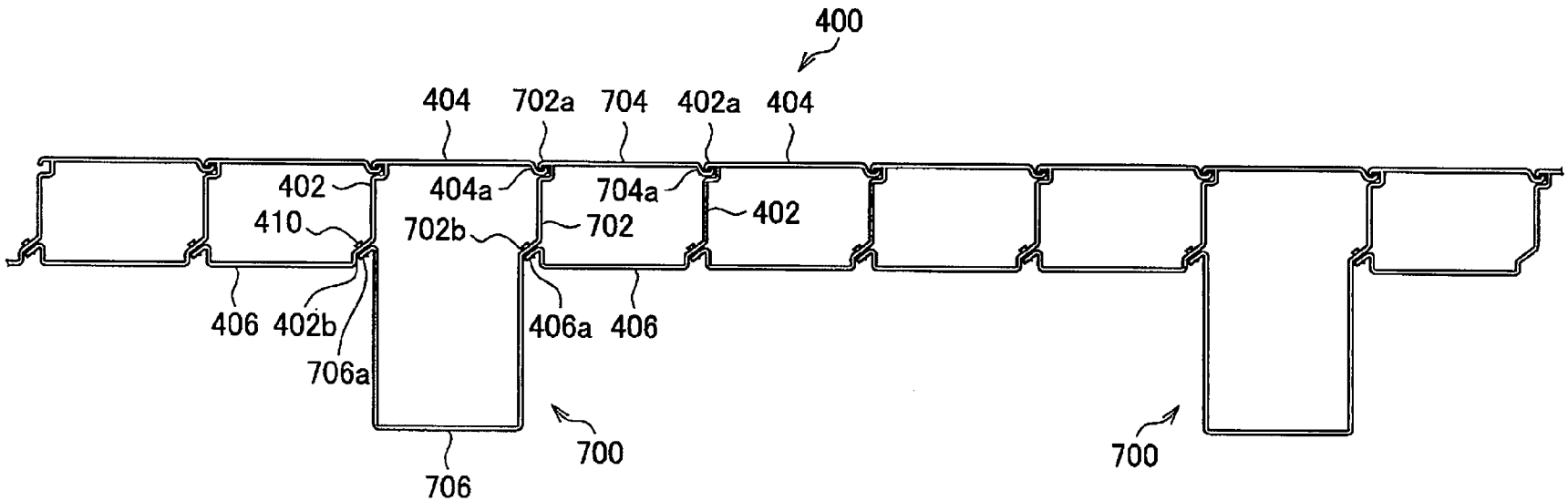
FIG. 18 is a side view showing a floor structure according to a seventh embodiment of the present invention.

Next, a floor structure according to a seventh embodiment of the present invention will be described. FIG. 18 is a side view showing the floor structure according to the present embodiment.

The floor structure according to the present embodiment is provided with the structural steel materials 400 of the above described fourth embodiment, and is additionally provided with floor beam structural steel materials 700. The floor beam structural steel materials 700 have a web 702, a top flange 704, and a bottom flange 706, and also have a fitting portion 702*a*, an inclined portion 702*b*, and an engaging portion 704*a*. The web 702, the top flange 704, the fitting portion 702*a*, the inclined portion 702*b*, and the engaging portion 704*a* are the same as those in the above described fourth embodiment, therefore, a detailed description thereof is omitted.

The bottom flange 706 protrudes in a downward direction below the bottom end portion of the web 702. The bottom flange 706 has two surfaces that are parallel to the web 702, and a surface that is parallel to the top flange 704, and has a U-shaped cross section. A bent portion 706*a* whose distal end points downwards is formed on a distal end of the bottom flange 706. When a floor beam structural steel material 700 is laid so as to form at least a portion of a floor structure, the bent portion 706*a* of the bottom flange 706 is in contact with the inclined portion 402*b* of the bottom end of the web 402 of the adjacent structural steel material 400. In addition, when a structural steel material 400 is joined to a floor beam structural steel material 700, as is shown in FIG. 18, the inclined portion 402*b* is mounted on the bent portion 706*a* and in contact therewith, and these two are then joined together by drill screws 410.

When the floor beam structural steel materials 700 are laid in a floor structure, because they protrude below the bottom flanges 406 of the structural steel materials 400, and have a U-shaped cross section, they function as beam components for the floor structure. Accordingly, in an erected construction which uses the floor beam structural steel materials 700, it is possible to omit joists such as binding joists, and thereby achieve an improvement in workability and a lift in profitability.

The cross section of the bottom flange 706 of the floor beam structural steel material 700 is not limited to being a U-shaped cross section, as is described above, and, provided that a bulge portion is formed that bulges downwards from the bottom end portion of the web 702, it is also possible for this cross section to be formed in a semi-circular shape or the like.

Eighth Embodiment

Figure 19:
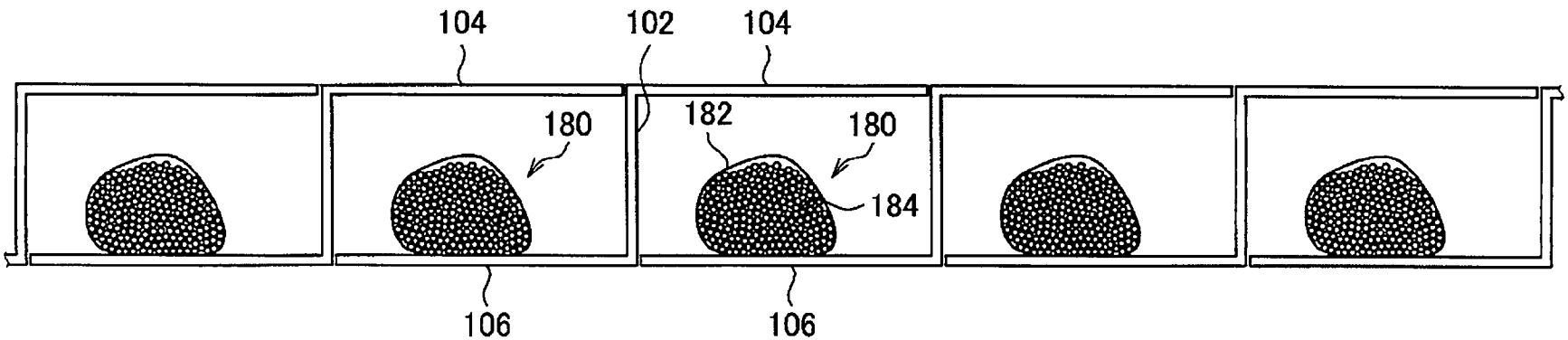
FIG. 19 is a side view showing a floor structure according to an eighth embodiment of the present invention.

Next, a floor structure according to an eighth embodiment of the present invention will be described. FIG. 19 is a side view showing the floor structure according to the present embodiment.

The floor structure according to the present embodiment is provided with the above described structural steel materials 100 according to the first embodiment, and with noise-proofing material 180. The structural steel materials 100 are the same as the structural steel materials 100 in the above described first embodiment, therefore, a detailed description thereof is omitted.

The noise-proofing materials 180 are provided with a bag 182, and with granular material 184. The bag 182 may be formed, for example, from an elastic material. The granular material 184 may be formed, for example, by reduced iron pellets. By placing the noise-proofing materials 180 inside a floor structure which is formed by the structural steel materials 100, the present embodiment makes it possible to prevent noise and vibration being transmitted from a floor above to a floor below. Note that, instead of the noise-proofing material 180, it is also possible to place a weight or a mechanical damper or the like inside the structural steel materials in order to control the characteristic value of the floor vibration.

According to the present embodiment, when a floor structure is being constructed, a noise-proofing material 180 is placed on top of the bottom flange 106 of a structural steel material 100, and the next structural steel material 100 to be laid is then installed so as to cover this bottom flange 106 and noise-proofing material 180. When laying the box-shaped steel 10 of the conventional technology, it is necessary to insert the noise-proofing materials 180 via end portions of the box-shaped steel 10 so that the construction process is extremely time-consuming. In contrast, according to the present embodiment, because the noise-proofing materials 180 can be mounted on the bottom flanges 106 while the structural steel materials 100 are being laid, it is possible to reduce both the time and the costs needed for the construction process.

Note that the present invention is not limited to cases in which the noise-proofing material is placed on top of the bottom flange 106, and the noise-proofing material may also be suspended from the top flange 104. Furthermore, a noise-proofing material may also be formed by filling the space between the bottom flange and the top flange with concrete.

Ninth Embodiment

Figure 20A:
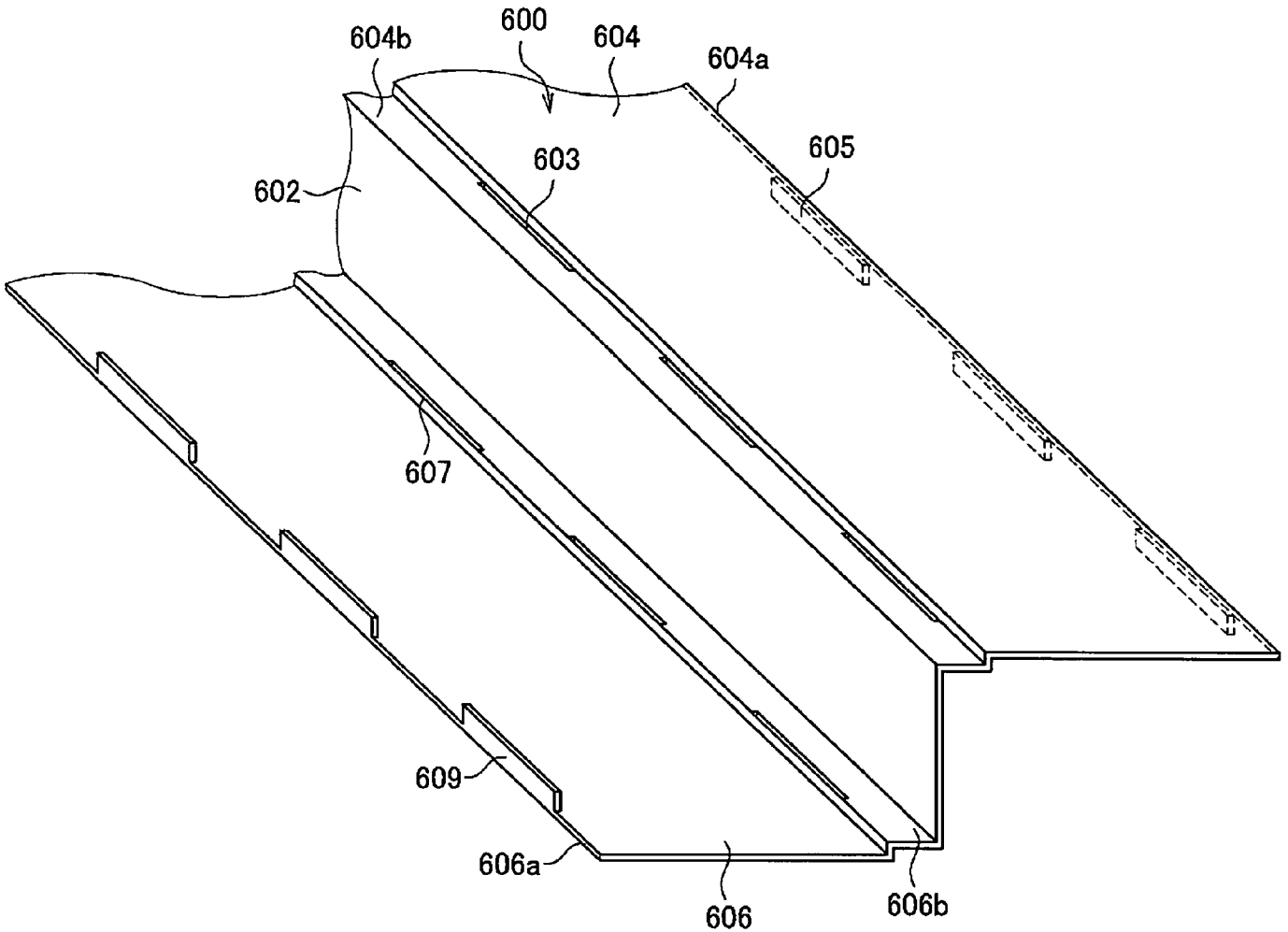
FIG. 20A is a perspective view showing a structural steel material according to a ninth embodiment of the present invention.
Figure 20B:
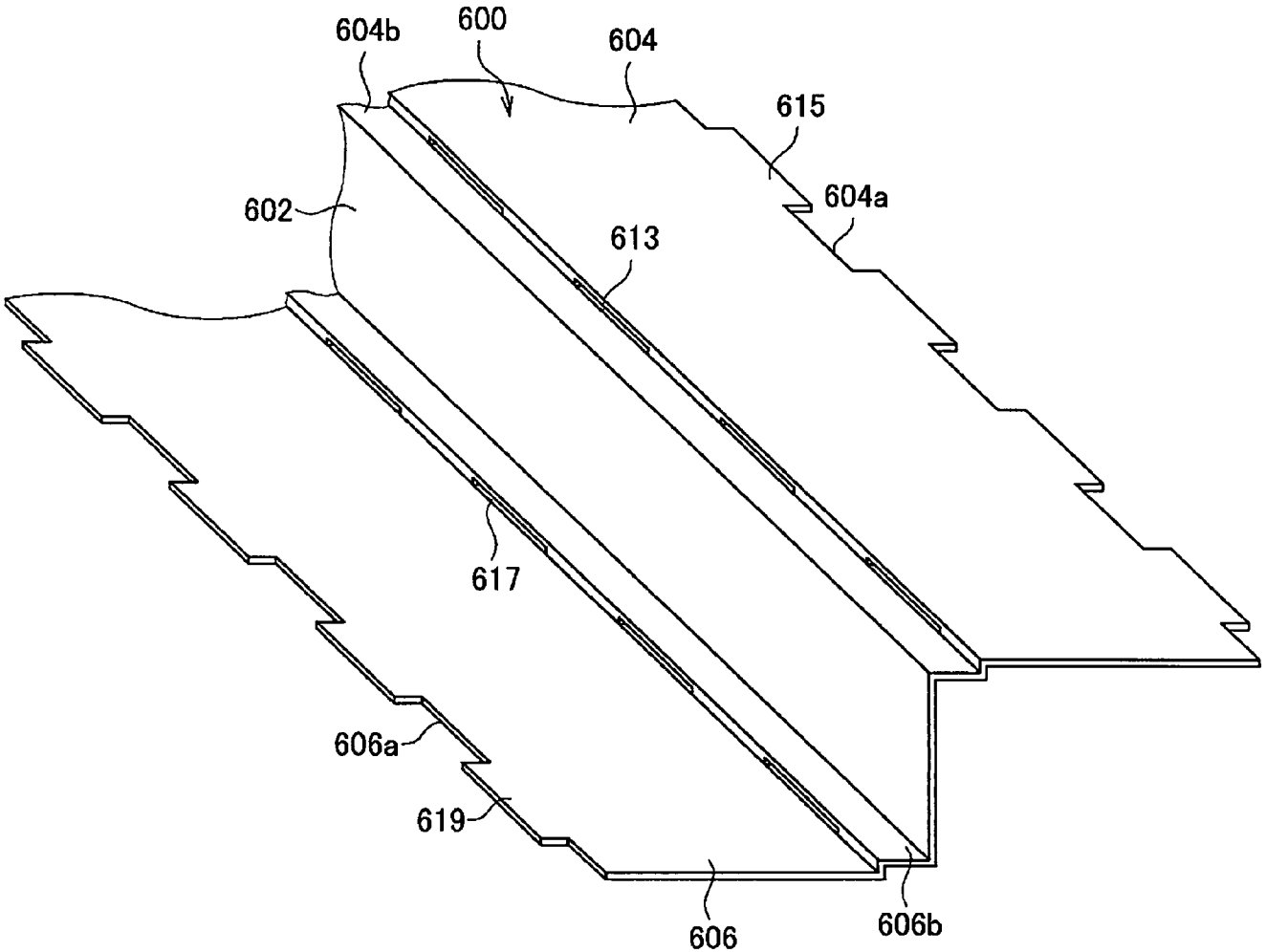
FIG. 20B is a perspective view showing the structural steel material according to the embodiment.
Figure 21:
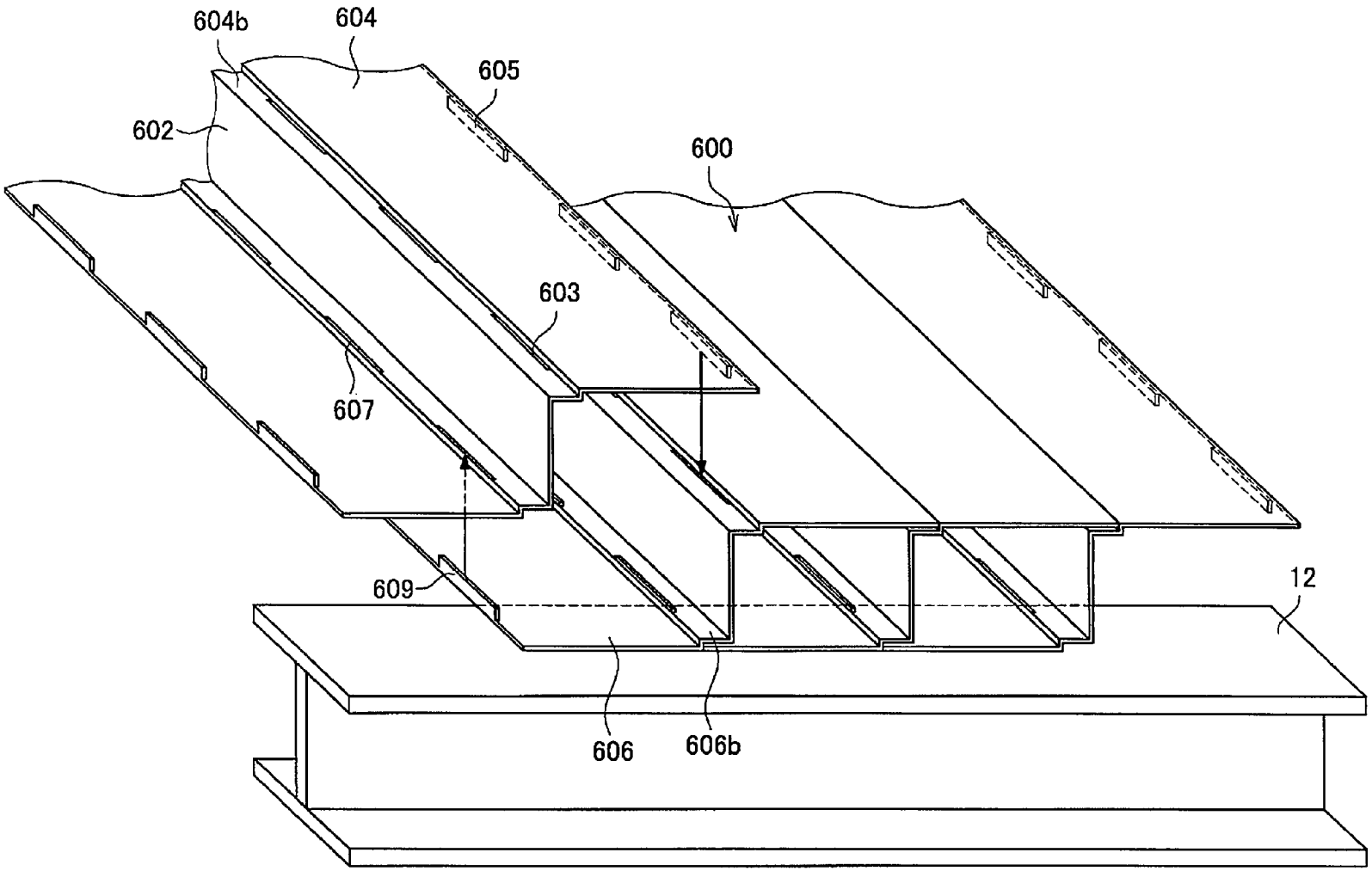
FIG. 21 is a perspective view showing a structural steel material and a floor structure according to the embodiment.

Next, a floor structure according to a ninth embodiment of the present invention will be described. FIGS. 20A and 20B are perspective views showing a structural steel material according to the present embodiment. FIG. 21 is a perspective view showing a structural steel material and the floor structure according to the present embodiment.

As is shown in FIG. 20A, connection protruding portions 605 are formed on a structural steel material 600 according to the present embodiment so as to extend along an end portion 604*a* of a top flange 604 in the longitudinal direction thereof. In addition, connection aperture portions 603 are formed in a step portion 604*b* that is provided in the vicinity of a join portion between a top end of a web 602 and a top flange 604 of the structural steel material 600. As is shown in FIG. 21, the connection protruding portions 605 are inserted into the connection aperture portions 603, so that the two can be engaged with each other. It is desirable for the connection aperture portions 603 to be formed as small as possible, while being sufficiently large considering the size of the connection protruding portions 605. The smaller the connection aperture portions 603, the stronger the mutual connection between adjacent structural steel materials 600 can be made. A plurality of both the connection aperture portions 603 and the connection protruding portions 605 are provided separate from each other. The step portion 604*b* is formed such that a top surface of a step portion 606*b* is positioned below a top surface of the top flange 604. The length in the longitudinal direction of the connection protruding portions 605, and the spacing between adjacent connection protruding portions 605 can be appropriately set, and it is not necessary for these to be the same length or to be placed at a uniform spacing.

Connection protruding portions 609 are formed extending along an end portion 606*a* of a bottom flange 604 in the longitudinal direction thereof. In addition, connection aperture portions 607 are formed in a step portion 606*b* that is provided in the vicinity of a join portion between a bottom end of the web 602 and a bottom flange 606. The connection protruding portions 609 are inserted into the connection aperture portions 607, so that these two can be engaged with each other. A plurality of both the connection aperture portions 607 and the connection protruding portions 609 are provided separate from each other. The step portion 606*b* is formed such that the top surface of the step portion 606*b* is positioned below a top surface of the bottom flange 606.

As is shown in FIGS. 20A and 21, the connection protruding portions 605 and 609 are plate-shaped components that are elongated in the longitudinal direction of the structural steel materials 600, while, as is shown in FIGS. 20A and 21, the connection aperture portions 603 and 607 are slit-shaped apertures that extend in the longitudinal direction of the structural steel materials 600. The present invention is not limited to this, however, and the connection protruding portions may be rod-shaped projecting components instead of plate-shaped components, while the connection aperture portions may be circular or angular apertures that conform to the rod-shaped connection protruding portions.

As is shown in FIG. 21, a floor structure is formed by laying the structural steel materials 600 according to the present embodiment in parallel with each other. In addition, by placing end portions in the longitudinal direction of the structural steel materials 600 on a top surface of a beam component 12, the structural steel materials 12 are laid with stability as the floor structure of an erected construction.

Note that, in FIGS. 20A and 21, a case is shown in which the connection protruding portions 605 and 609 are formed perpendicularly relative to the surface of the top flange 604 and the surface of the bottom flange 606 respectively, however, the present invention is not limited to this example. For example, as is shown in FIG. 20B, it is also possible for connection protruding portions 615 and 619 to protrude respectively in a direction parallel to the surface of the top flange 604 and in a direction parallel to the surface of the bottom flange 606. At this time, unlike the connection aperture portions 603 and 607 shown in FIGS. 20A and 21, connection aperture portions 613 and 617 are formed opening in a perpendicular direction relative to the web 602. The connection protruding portions 615 and 619 of one structural steel material 600 are inserted into the connection aperture portions 613 in 617 of another structural steel material 600 which is adjacent to the first structural steel material 600. In addition, although omitted from the drawings, it is also possible for the connection protruding portions to be formed at an obtuse angle or at an acute angle relative to the surface of the top flange 604 and to the surface of the bottom flange 606. By employing the structure, the manufacturability and workability of the floor structure is increased.

According to the floor structure of the present embodiment, because joins between the top flange 604 and the bottom flange 606 of adjacent structural steel materials 600 are further strengthened, it is possible to increase the in-plane shear rigidity of the floor.

Tenth Embodiment

Figure 22A:
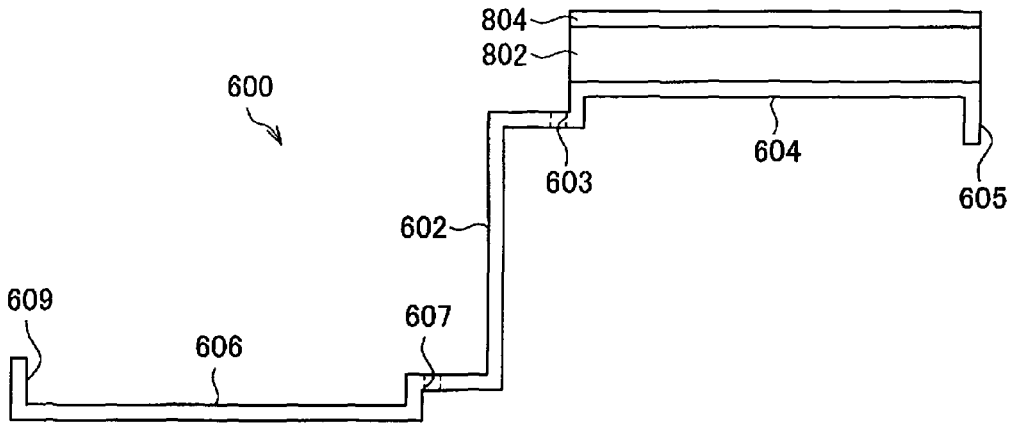
FIG. 22A is a side view showing a structural steel material according to a tenth embodiment of the present invention.
Figure 22B:
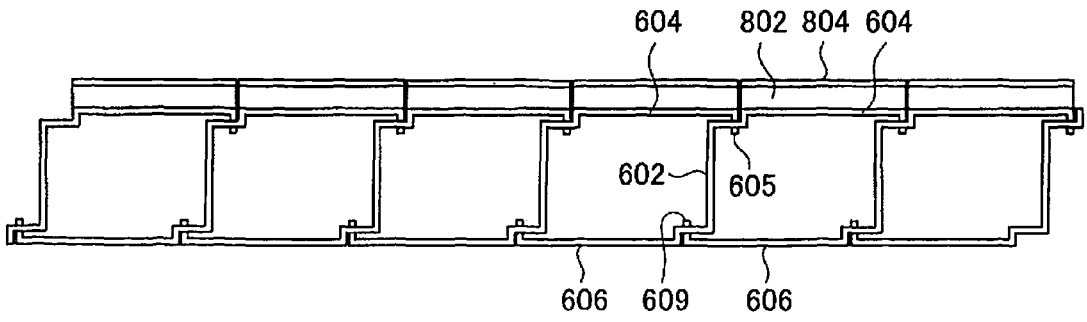
FIG. 22B is a side view showing a structural steel material and a floor structure according to the embodiment.

Next, a floor structure according to a tenth embodiment of the present invention will be described. FIGS. 22A and 22B are side views showing a structural steel material according to the present embodiment. In the above described embodiment, a case is described in which the structural steel materials independently form a floor structure, however, in actual fact, the floor surface is only completed when a finishing material is formed on top of the floor structure. In the present embodiment, this finishing material is prepared in advance.

As is shown in FIG. 22A, an aerated lightweight concrete panel (ALC panel) 802 is laid on a top surface of the top flange 604 of a structural steel material 600 of the present embodiment, and is affixed thereto. Plasterboard 804 or the like is then laid on a top surface of the aerated lightweight concrete panel (ALC panel) 802. If these board materials are formed in advance as a single unit together with the structural steel materials 600, then the number of on-site tasks to be performed can be reduced. As a result, it is possible to improve the workability of the floor structure and to also improve the overall workability of the construction job. In addition, as is shown in FIG. 22B, by laying a plurality of the structural steel materials 600 in parallel with each other, a floor structure and a floor surface made up of board materials are formed at the same time.

Note that the board material that is laid on and affixed to the top surface of the top flange 604 may be a concrete board, a wooden board (e.g., structural plywood, laminated lumber or the like), slate, a ceramic board, a glass wool board, a metal panel, or a ceramic-based siding board (e.g., a slag cement perlite board) or the like.

Eleventh Embodiment

Figure 23:
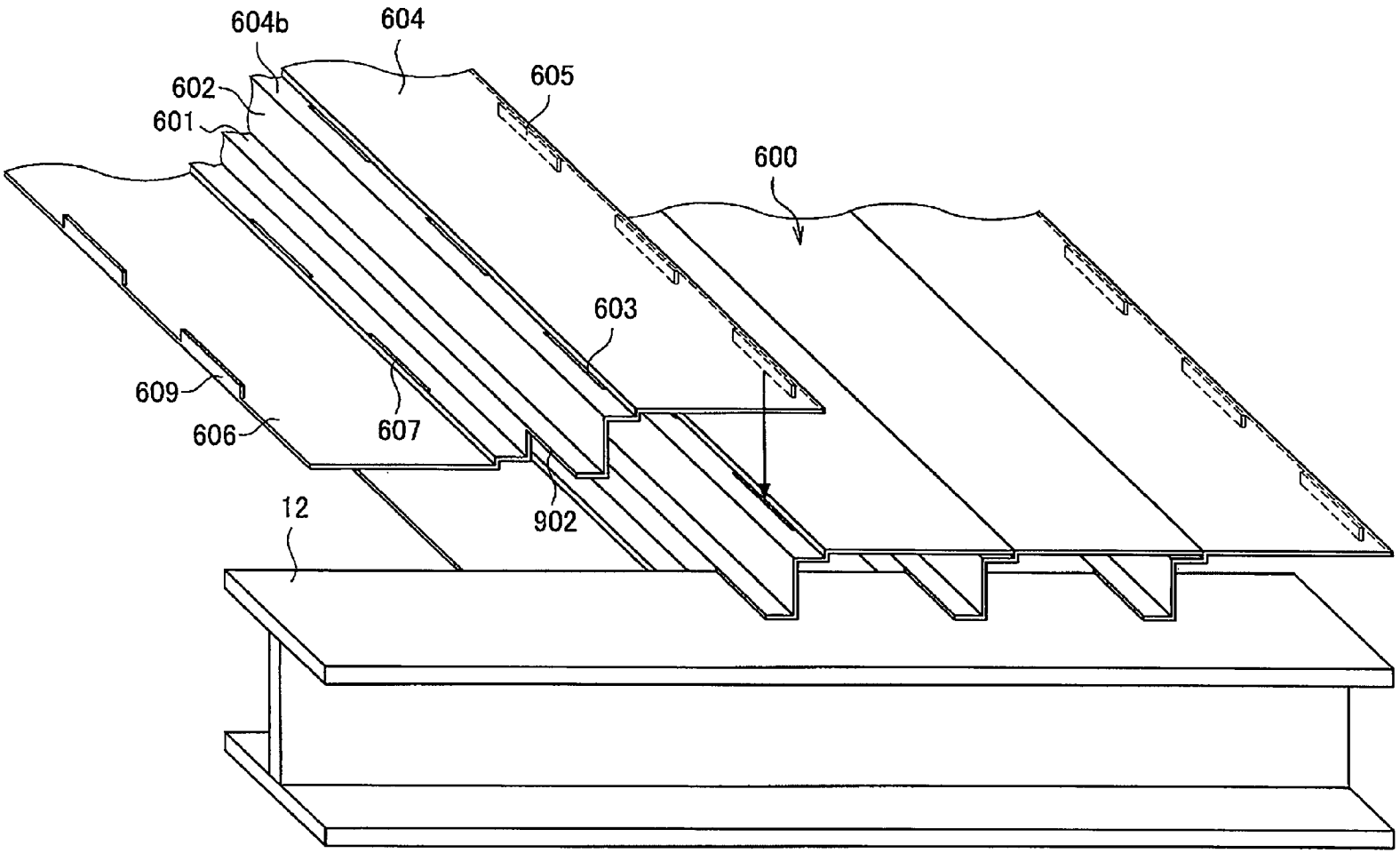
FIG. 23 is a perspective view showing a structural steel material and a floor structure according to an eleventh embodiment of the present invention.

Next, a floor structure according to an eleventh embodiment of the present invention will be described. FIG. 23 is a perspective view showing a structural steel material and the floor structure according to the present embodiment. FIGS. 24A to 24G are perspective views showing a structural steel material according to the present embodiment.

In the above described ninth embodiment, a case is described in which, as is shown in FIG. 21, the structural steel members 600 are laid such that the bottom surface of the bottom flange 606 is in contact with the beam component 12 at end portions in the longitudinal direction of the structural steel materials 600, however, the method of connecting structural steel materials to beam components of the present invention is not limited to this example.

Figure 24A:
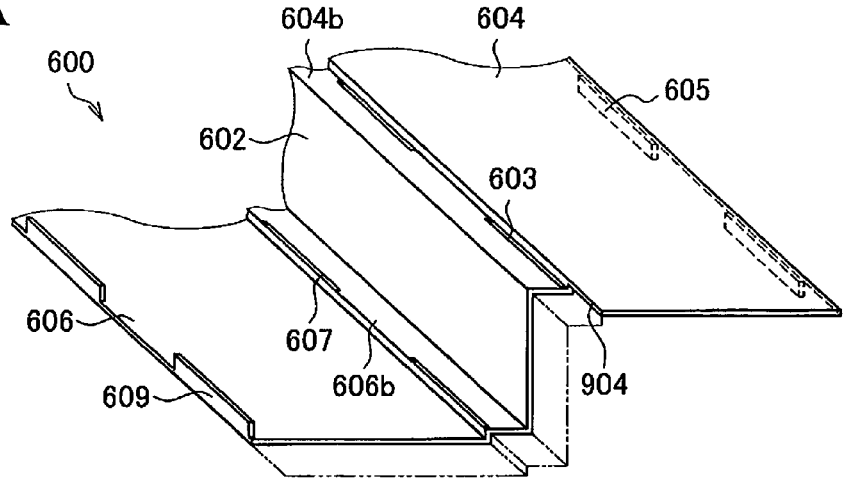
FIG. 24A is a perspective view showing a structural steel material according to the embodiment.
Figure 24B:
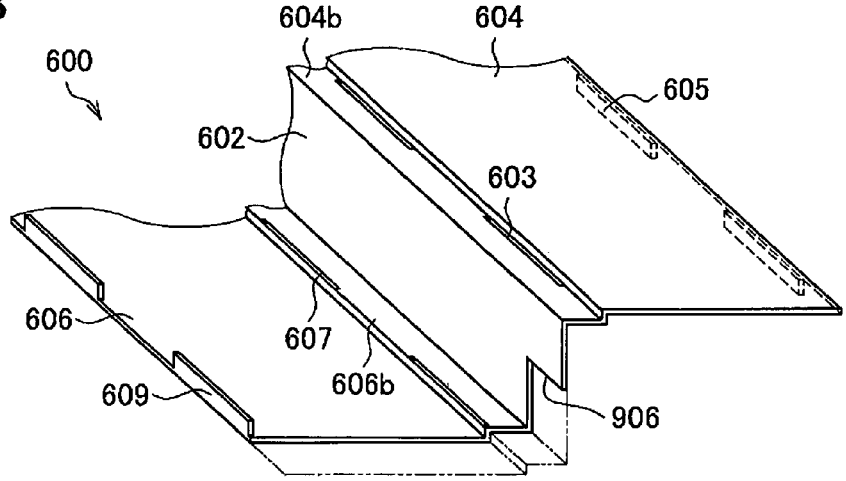
FIG. 24B is a perspective view showing a structural steel material according to the embodiment.
Figure 24C:
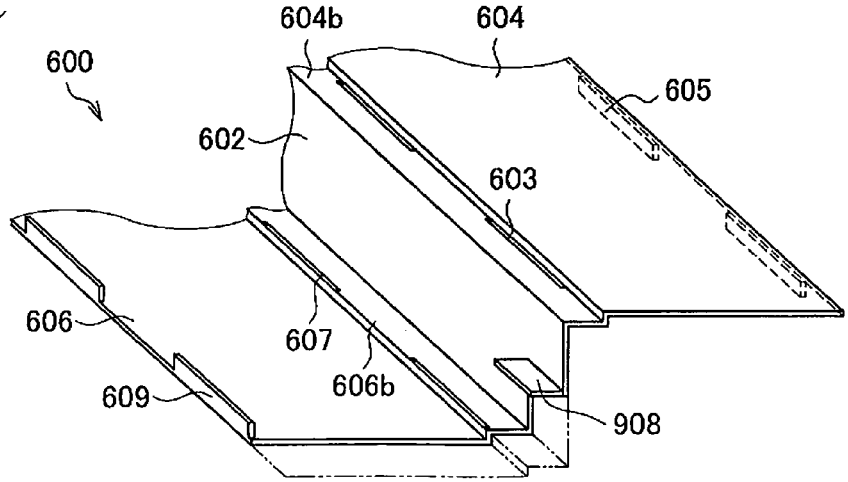
FIG. 24C is a perspective view showing a structural steel material according to the embodiment.
Figure 24D:
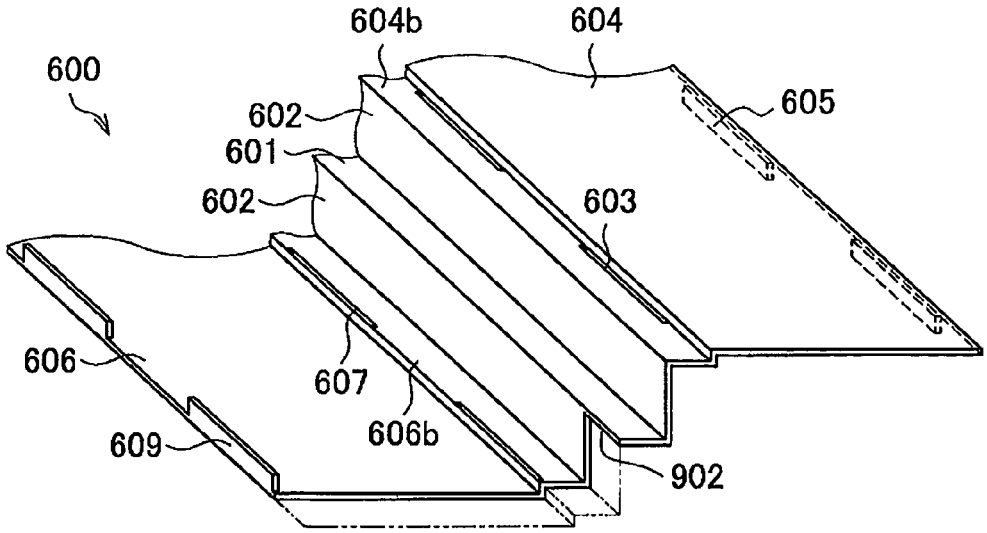
FIG. 24D is a perspective view showing a structural steel material according to the embodiment.

In the present embodiment, as is shown, for example, in FIGS. 23 and 24D, a notch portion 902 is provided in an end portion in the longitudinal direction of the bottom flange 606 and the web 602 of the structural steel material 600, and the structural steel material 600 is connected to the top surface of the beam component 12 via the notch portion 902. A step portion 601 that is parallel with the top flange 604 and the bottom flange 606 is provided in the web 602 of the structural steel material 600. When the notch portion 902 is connected to the top of the beam component 12, the step portion 601 and the web 602 support the structural steel material 600.

Because this structure is employed, the height of the floor structure from the top surface of the beam component 12 is the same as the height from the notch portion 902 to the top flange 604. As a result, the height of the floor structure from the top surface of the beam component 12 is lower compared with when the structural steel material 600 is laid with the bottom surface of the bottom flange 606 of the structural steel material 600 in contact with the top of the beam component 12, as is shown in FIG. 21. This makes it possible to lower the floor level of each floor of an erected construction.

Note that the notch portion of the present invention is not limited to the example shown in FIGS. 23 and 24D, and notch portions such as those shown, for example, in FIGS. 24A to 24C and FIGS. 24E to 24G may also be used. In the example shown in FIG. 24A, instead of the step portion 601 being provided in the web 602, a notch portion 904 is formed by cutting an end portion in the longitudinal direction of a step portion 604*b*, the web 602, and the bottom flange 606. In the example shown in FIG. 24B, a notch portion 906 is formed by cutting an end portion in the longitudinal direction of the web 602 and the bottom flange 606. Here, the notch portion 906 extends part way in the height direction of the web 602. In the example shown in FIG. 24C, in addition to the notch portion 906 shown in FIG. 24B, there is also provided a bent portion 908. The bent portion 908 has a surface that is parallel to the top flange 604 and the bottom flange 606. As is shown in this example, the notch portion of the present invention is not limited to being formed by cutting a portion of a structural steel material, and it may also be formed by bending.

Figure 24E:
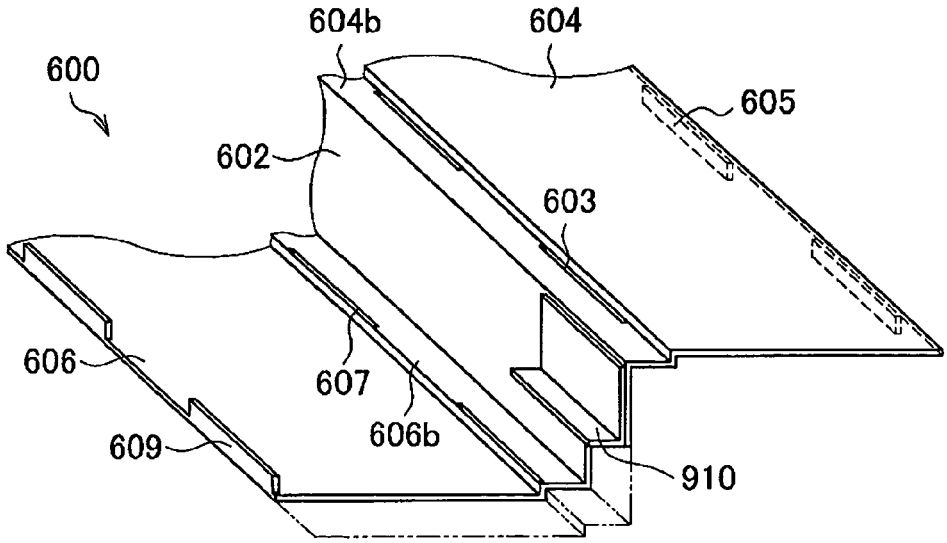
FIG. 24E is a perspective view showing a structural steel material according to the embodiment.
Figure 24F:
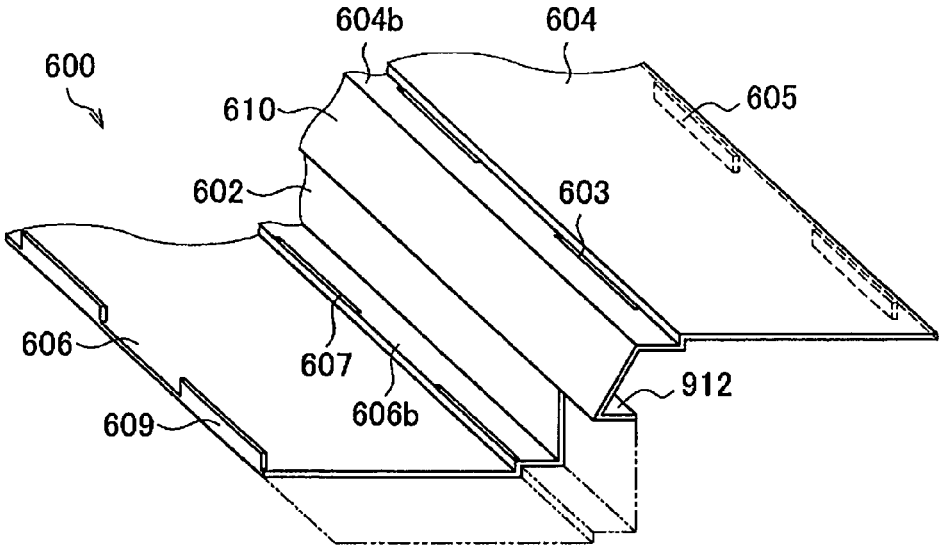
FIG. 24F is a perspective view showing a structural steel material according to the embodiment.

In the example shown in FIG. 24E, in addition to the notch portion 906 shown in FIG. 24B, there is also provided a bent portion 910. The bent portion 910 is formed when a steel material having an L-shaped cross section is connected to the surface of the web 602. In the example shown in FIG. 24F, a web 610 is formed so as to be at an obtuse angle relative to the top flange 604, and a bent portion 912 is formed so as to extend in parallel with the surface of the top flange 604 in the direction of the top flange 604. The web 602 is perpendicular to the bottom flange 606, and is connected to an end portion of the bent portion 912. In this example, the notch portion is formed by cutting the web 602 and the bottom flange 606 at an end portion in the longitudinal direction thereof.

Figure 24G:
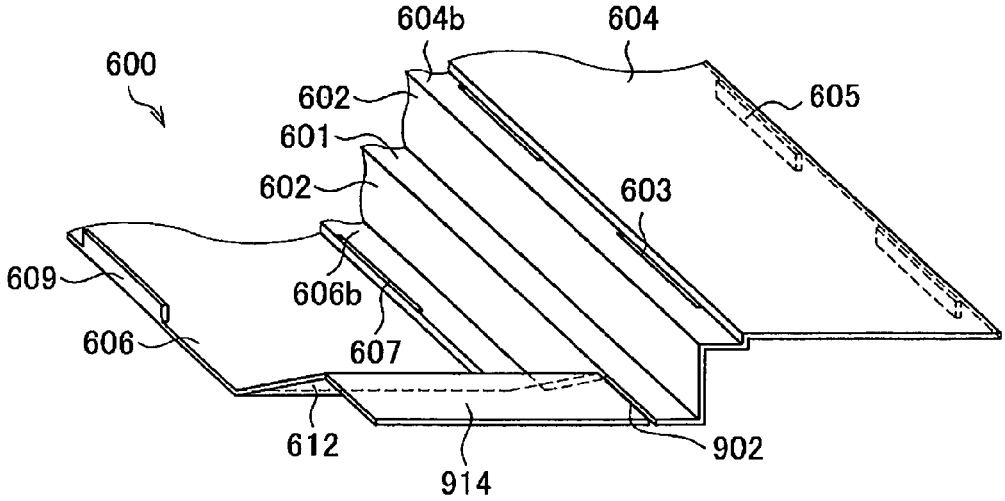
FIG. 24G is a perspective view showing a structural steel material according to the embodiment.

In the example shown in FIG. 24G, in addition to the notch portion 902 shown in FIG. 24D, there is also provided a bent portion 914. The bottom flange 606 has a bent portion 612 which is bent at an end portion in the longitudinal direction thereof so as to be at the same height as the step portion 601. The bent portion 914 is formed at an end portion of the bent portion 612 so as to have a surface that is parallel with the top flange 604 and the bottom flange 606. By employing this structure, the structural steel material 600 is supported at an end portion in the longitudinal direction thereof on a top surface of structural framework such as the beam component 12 by means of the bent portion 914 and the step portion 601.

Preferred embodiments of the present invention are described above with reference to the attached drawings, however, it is to be understood that the present invention is not limited to these examples. It is clear that one skilled in the art may consider various alterations and modifications within the categories described by the range of the claims, and it should be understood that these alterations and modifications would naturally also form part of the technical range of the present invention.

Figure 25A:
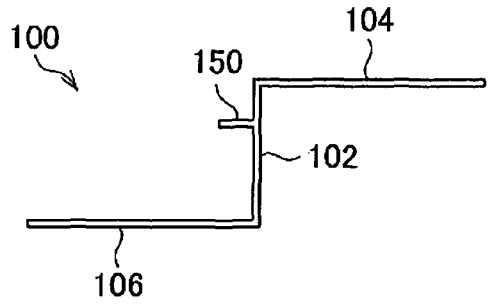
FIG. 25A is a side view showing a modified example of the structural steel material according to the first embodiment of the present invention.
Figure 25B:
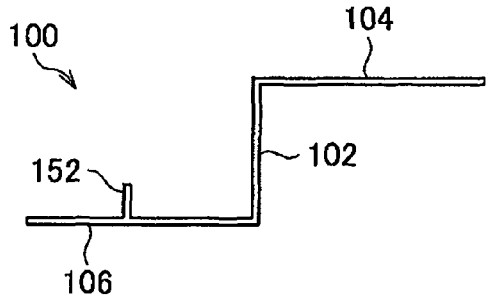
FIG. 25B is a side view showing a modified example of the structural steel material according to the embodiment.

For example, in the above described embodiments, a description is given of a case in which the web 102, the top flange 104, and the bottom flange 106 are flat steel plates, however, the present invention is not limited to this example. A description will now be given of a variant example of the present invention with reference to FIGS. 25A through 25D. FIGS. 25A through 25D are side views showing the structural steel material according to the first embodiment of the present invention. For example, as is shown in FIG. 25A, it is also possible for a rib 150 to be formed on the web 102, and, as is shown in FIG. 25B, it is also possible for a rib 152 to be formed on the bottom flange 106. These ribs 150 and 152 are planar materials that are perpendicular respectively to the web 102 and the bottom flange 106 on which the ribs 150 and 152 are respectively provided and that extend in the longitudinal direction of the structural steel material 100. The ribs 150 and 152 are shorter than the height of the web 102 and the widths of the top flange 104 and the bottom flange 106. Note that, although not shown in the drawings, it is also possible for a rib to be formed on the top flange 104.

Figure 25C:
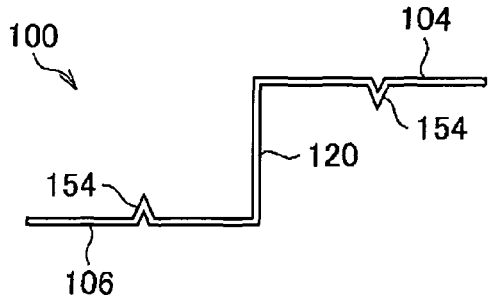
FIG. 25C is a side view showing a modified example of the structural steel material according to the embodiment.
Figure 25D:
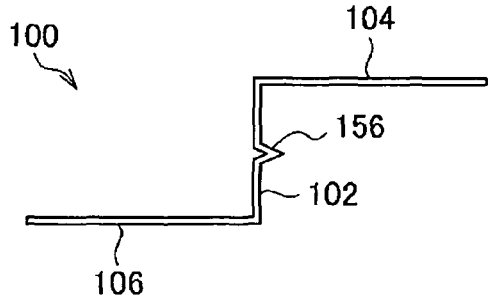
FIG. 25D is a side view showing a modified example of the structural steel material according to the embodiment.

Moreover, as is shown in FIG. 25C, it is also possible for ribs 154 to be formed on the top flange 104 and the bottom flange 106, and, as is shown in FIG. 25D, it is also possible for a rib 156 to be formed on the web 102. The ribs 154 and 156 protrude on one surface side so that a groove is formed on the other surface side, and they extend in the longitudinal direction of the top flange 104, the bottom flange 106, and the web 102.

Note that a rib that is formed on the web 102 so as to protrude in the direction in which the bottom flange 106 extends may also function as a connection surface that is provided at a position below the top surface of the top flange. In this case, the distal end portion of the top flange 104 of the structural steel material 100 that is laid adjacent thereto is connected to the rib that is also functioning as a connection surface.

The present variant example makes it possible as a result of the ribs 150, 152, 154, and 156 being formed to improve the out-of-plane flexural rigidity and improve the localized buckling strength of plate elements such as the web 102, the top flange 104, and the bottom flange 106. Accordingly, it is possible to lighten the weight of the structural steel materials 100 which, in turn, makes it possible to reduce manufacturing costs and increase profitability.

Figure 26A:
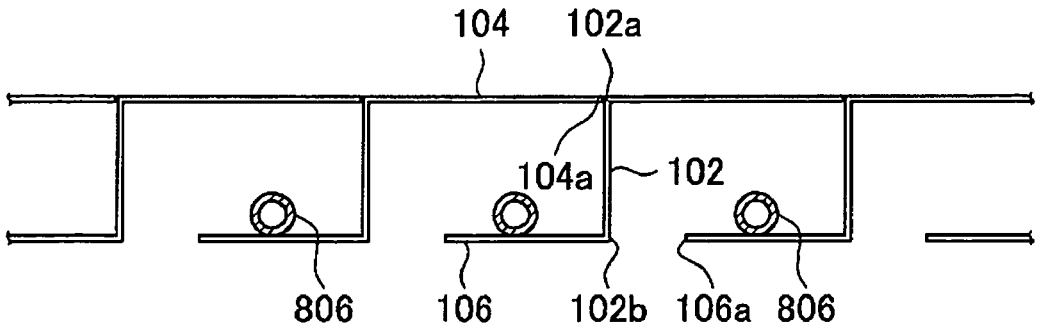
FIG. 26A is a side view showing a modified example of a floor structure according to the embodiment.
Figure 26B:
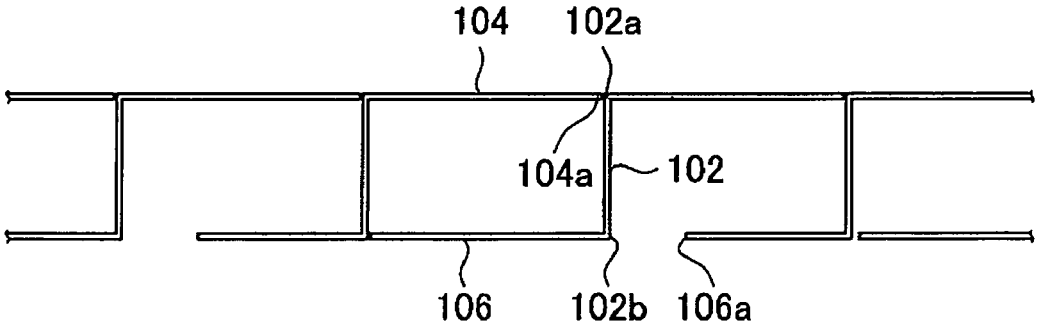
FIG. 26B is a side view showing a modified example of the floor structure according to the embodiment.
Figure 27A:
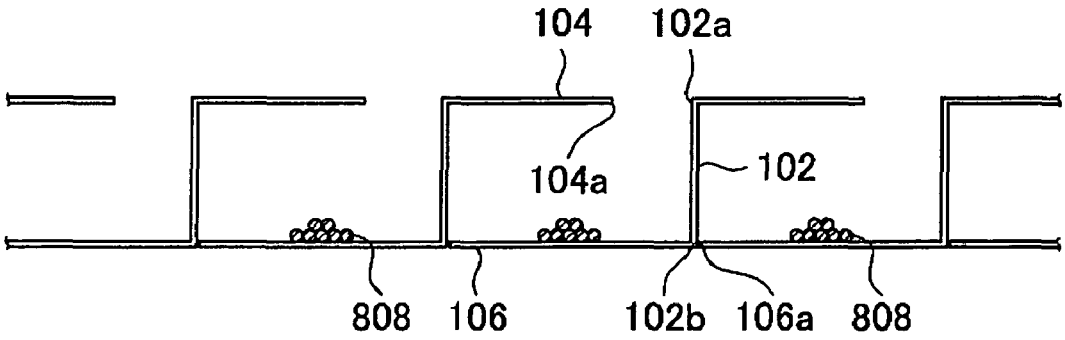
FIG. 27A is a side view showing a modified example of the floor structure according to the embodiment.
Figure 27B:
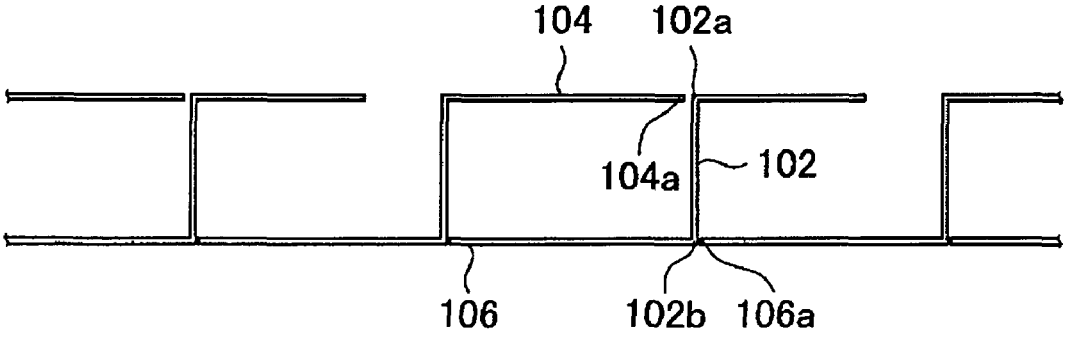
FIG. 27B is a side view showing the modified example of the floor structure according to the embodiment.

A description will now be given of another variant example of the structural steel material according to the first embodiment of the present invention with reference to FIGS. 26A and 26B and FIGS. 27A and 27B. FIGS. 26A and 26B are side views showing a variant example of the structural steel material according to the first embodiment. FIGS. 27A and 27B are side views showing a variant example of the structural steel material according to the first embodiment. In the above described embodiment, the end portion 104*a* of the top flange 104 is in contact with the top end portion 102*a* of the web 102, and the end portion 106*a* of the bottom flange 106 is also in contact with the bottom end portion 102*b* of the web 102. However, the present invention is not limited to this example. For example, as is shown in FIG. 26A, it is also possible to form a structural steel material 100 in which the bottom flange 106 has a shorter width than the top flange 104. If a floor structure is formed by laying a plurality of these structural steel materials 100 parallel to each other, then an aperture portion is formed between the bottom end portion 102*b* of the web 102 and the end portion 106*a* of the bottom flange 106 on the bottom surface side of the floor structure. Moreover, as is shown in FIG. 26B, by laying a combination of the structural steel materials according to the present variant example and the structural steel materials 100 in which the lengths of the top flange 104 and the bottom flange 106 are equal, it is possible to form aperture portions only in locations where they are necessary on the bottom surface side of the floor structure.

According to the present variant example, as a result of structural steel materials 100 in which the bottom flanges 106 have a shorter width than the top flanges 104 being used for a floor structure, it is possible to insert metal fittings that are used to suspend a ceiling or rafters into the aperture portions that are formed in the bottom surface of the floor structure. As a result, it is possible to improve the workability of an erected construction. Furthermore, it is also possible to install dampers or piping equipment 806, or electrical cables or the like inside the floor structure through the aperture portions formed in the bottom surface of the floor structure.

Conversely to the variant example shown in FIGS. 26A to 26B, as is shown in FIG. 27A, when a floor structure is formed by laying in parallel with each other a plurality of structural steel materials 100 whose top flange 104 has a shorter width than the bottom flange 106, then an aperture portion is formed between the top end portion 102*a* of the web 102 and the end portion 104*a* of the top flange 104 on the top surface side of the floor structure. Moreover, as is shown in FIG. 27B, by laying a combination of the structural steel materials according to the present variant example and the structural steel materials 100 in which the lengths of the top flange 104 and the bottom flange 106 are equal, it is possible to form aperture portions only in locations where they are necessary on the top surface side of the floor structure.

According to the present variant example, as a result of structural steel materials 100 in which the top flanges 104 have a shorter width than the bottom flanges 106 being used for a floor structure, it is possible to install dampers or piping equipment, or electrical cables 808 or the like inside the floor structure through the aperture portions formed in the top surface of the floor structure. This enables post-installation maintenance to be performed via the aperture portions.

Figure 28A:
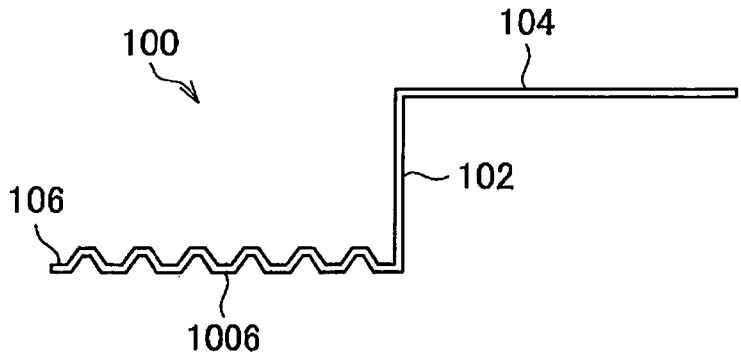
FIG. 28A is a side view showing a modified example of the structural steel material according to the embodiment.
Figure 28B:
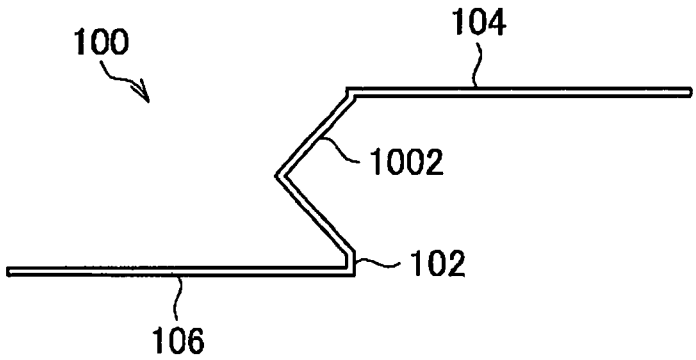
FIG. 28B is a side view showing a modified example of the structural steel material according to the embodiment.
Figure 28C:
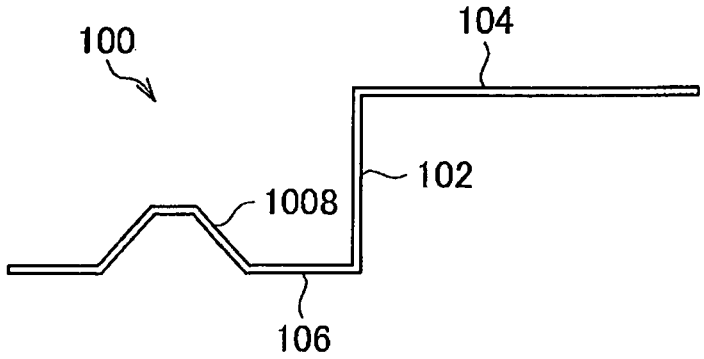
FIG. 28C is a side view showing a modified example of the structural steel material according to the embodiment.

Further variant examples of the structural steel material according to the first embodiment of the present invention will now be described with reference to FIGS. 28A to 28C. FIGS. 28A to 28C are side views showing variant examples of the structural steel material according to the present embodiment. The present invention is not limited to cases in which the web, the top flange, and the bottom flange are flat steel plate components. For example, as is shown in FIG. 28A, it is also possible for bent ribs 1006 having a waveform cross section to be provided on the bottom flange 106 or the top flange 104. Moreover, as is shown in FIG. 28B, it is also possible for a bent rib 1002 to be provided on the web 102. The bent rib 1002 is bent either once or a plurality of times over the height direction of the web 102. As is shown in FIG. 28C, it is also possible to provide a bent rib 1008 in the bottom flange 106 or the top flange 104. The bent rib 1008 is bent either once or a plurality of times over the direction in which either the bottom flange 106 or the top flange 104 extends. By employing these structures, it is possible to improve the out-of-plane flexural rigidity and improve the localized buckling strength of plate elements such as the web 102, the top flange 104, and the bottom flange 106.

Moreover, in the above described embodiments, cases are illustrated in which the web, the top flange, and the bottom flange are plate-shaped components without any holes in them, however, the present invention is not limited to such examples. For example, it is also possible to use plate-shaped components in which through holes or through grooves have been formed in the web, top flange, or bottom flange.

INDUSTRIAL APPLICABILITY

It is possible to provide a new and improved floor structure that makes it possible to reduce the costs involved both in manufacturing the floor structure and in transporting the steel materials used in the manufacturing thereof.

The invention claimed is:

1. A floor structure comprising a plurality of structural metal components that each have: a plate-shaped supporting portion that is laid either perpendicular or oblique to an installation surface; a plate-shaped top flange that extends from a top end portion of the supporting portion in parallel with the installation surface; a plate-shaped bottom flange that extends from a bottom end portion of the supporting portion in parallel with the installation surface and in the opposite direction from the top flange, wherein the structural metal components are laid on a flat surface in parallel with each other such that the top flange of one of the mutually adjacent structural metal components covers the bottom flange of the other of the mutually adjacent structural metal material, thereby forming a floor structure, an end structural metal component at an end portion of the floor structure having a different cross section than the other structural metal components; wherein the end structural metal component comprises a U-shaped end component that extends from an end portion of the top flange or the bottom flange, with sides of the U-shaped end component being in parallel with the supporting portion and in the direction of the supporting portion, and an entire outermost side among the sides of the U-shaped end component is flat from a top to a bottom thereof.

2. The floor structure according to claim 1, wherein at least one of the supporting portion, the top flange, and the bottom flange is provided with a rib that protrudes from the surface thereof.

3. The floor structure according to claim 1, wherein an angle formed between the supporting portion and the top flange or the bottom flange is between 30° and 150°.

4. The floor structure according to claim 1, wherein a distal end portion of the top flange of one of the mutually adjacent structural metal components is connected to a top end portion of the supporting portion of the other of the mutually adjacent structural metal components.

5. The floor structure according to claim 4, wherein the supporting portion is provided with a connection surface that is formed on a top end portion thereof at a lower position than the top surface of the top flange; and the distal end portion of the top flange of one of the mutually adjacent structural metal components is connected to the connection surface of the other of the mutually adjacent structural metal components.

6. The floor structure according to claim 5, wherein the top flange is provided with a thin portion that is formed at the distal end portion thereof; and the thin portion of one of the mutually adjacent structural metal components is connected to the connection surface of the other of the mutually adjacent structural metal components.

7. The floor structure according to claim 4, wherein the supporting portion is provided with a fitting portion that is formed on a top end portion thereof; and the distal end portion of the top flange of one of the mutually adjacent structural metal components is fitted to the fitting portion of the other of the mutually adjacent structural metal components.

8. The floor structure according to claim 4, wherein the supporting portion is provided at the top end portion thereof with a protruding portion that protrudes in the extending direction of the bottom flange;

the top flange is provided at the distal end portion thereof with a step portion having a surface that is lower than the top surface of the top flange; and the step portion of one of the mutually adjacent structural metal components is connected to the protruding portion of the other of the mutually adjacent structural metal components.

9. The floor structure according to claim 4, wherein the top flange is provided on the distal end portion thereof with a connection protruding portion that extends in a longitudinal direction;

the supporting portion is provided either in the top end portion thereof and/or in the top flange adjacent to the top end portion thereof with a connection aperture portion that extends in the longitudinal direction; and the connection protruding portion in one of the mutually adjacent structural metal components is inserted into the connection aperture portion in the other of the mutually adjacent structural metal components.

10. The floor structure according to claim 9, wherein a plurality of the connection protruding portions and the connection aperture portions are provided separately from each other in the longitudinal direction.

11. The floor structure according to claim 1, wherein a distal end portion of the bottom flange of one of the mutually adjacent structural metal components is connected to a bottom end portion of the supporting portion of the other of the mutually adjacent structural metal components.

12. The floor structure according to claim 11, wherein the supporting portion is provided with a connection surface that is formed on a bottom end portion thereof at a higher position than the bottom surface of the bottom flange; and the distal end portion of the bottom flange of one of the mutually adjacent structural metal components is connected to the connection surface of the other of the mutually adjacent structural metal components.

13. The floor structure according to claim 12, wherein the bottom flange is provided with a thin portion that is formed at the distal end portion thereof; and the thin portion of one of the mutually adjacent structural metal components is connected to the connection surface of the other of the mutually adjacent structural metal components.

14. The floor structure according to claim 11, wherein the supporting portion is provided with a fitting portion that is formed on a bottom end portion thereof; and the distal end portion of the bottom flange of one of the mutually adjacent structural metal components is fitted to the fitting portion of the other of the mutually adjacent structural metal components.

15. The floor structure according to claim 1, wherein the supporting portion is provided at the bottom end portion thereof with a protruding portion that protrudes in the direction in which the top flange extends;

the bottom flange is provided at the distal end portion thereof with a step portion having a surface that is higher than the bottom surface of the bottom flange; and the step portion at the distal end portion of the bottom flange of one of the mutually adjacent structural metal components is connected to the protruding portion of the other of the mutually adjacent structural metal components.

16. The floor structure according to claim 11, wherein the bottom flange is provided on the distal end portion thereof with a connection protruding portion that extends in a longitudinal direction;

the supporting portion is provided either in the bottom end portion thereof and/or in the bottom flange adjacent to the bottom end portion thereof with a connection aperture portion that extends in the longitudinal direction; and the connection protruding portion in one of the mutually adjacent structural metal components is inserted into the connection aperture portion in the other of the mutually adjacent structural metal components.

17. The floor structure according to claim 16, wherein
a plurality of the connection protruding portions and the connection aperture portions are provided separately from each other in the longitudinal direction.

18. The floor structure according to claim 1, wherein
the distal end portion of the top flange of one of the mutually adjacent structural metal components is connected to the top end portion of the supporting portion of the other of the mutually adjacent structural metal components; and
the distal end portion of the bottom flange of one of the mutually adjacent structural metal components is connected to the bottom end portion of the supporting portion of the other of the mutually adjacent structural metal components.

19. The floor structure according to claim 18, wherein
the supporting portion is provided with a first connection surface that is formed on a top end portion thereof at a lower position than the top surface of the top flange;
the distal end portion of the top flange of one of the mutually adjacent structural metal components is connected to the first connection surface of the other of the mutually adjacent structural metal components;
the supporting portion is provided with a second connection surface that is formed on a bottom end portion thereof at a higher position than the bottom surface of the bottom flange; and
the distal end portion of the bottom flange of one of the mutually adjacent structural metal components is connected to the second connection surface of the other of the mutually adjacent structural metal components.

20. The floor structure according to claim 19, wherein
the top flange is provided with a first thin portion that is formed at the distal end portion thereof;
the first thin portion of one of the mutually adjacent structural metal components is connected to the first connection surface of the other of the mutually adjacent structural metal components;
the bottom flange is provided with a second thin portion that is formed at the distal end portion thereof; and
the second thin portion of one of the mutually adjacent structural metal components is connected to the second connection surface of the other of the mutually adjacent structural metal components.

21. The floor structure according to claim 18, wherein
the supporting portion is provided with a first fitting portion that is formed on a top end portion thereof;
the distal end portion of the top flange of one of the mutually adjacent structural metal components is fitted to the first fitting portion of the other of the mutually adjacent structural metal components;
the supporting portion is provided with a second fitting portion that is formed on a bottom end portion thereof; and
the distal end portion of the bottom flange of one of the mutually adjacent structural metal components is fitted to the second fitting portion of the other of the mutually adjacent structural metal components.

22. The floor structure according to claim 18, wherein
the supporting portion is provided at the top end portion thereof with a first protruding portion that protrudes in the direction in which the bottom flange extends;
the top flange is provided at the distal end portion thereof with a first step portion having a surface that is lower than the top surface of the top flange;
the first step portion of one of the mutually adjacent structural metal components is connected to the first protruding portion of the other of the mutually adjacent structural metal components;
the supporting portion is provided at the bottom end portion thereof with a second protruding portion that protrudes in the direction in which the top flange extends;
the bottom flange is provided at the distal end portion thereof with a second step portion having a surface that is higher than the bottom surface of the bottom flange; and
the second step portion of one of the mutually adjacent structural metal components is connected to the second protruding portion of the other of the mutually adjacent structural metal components.

23. The floor structure according to claim 18, wherein
the top flange is provided on the distal end portion thereof with a first connection protruding portion that extends in a longitudinal direction;
the supporting portion is provided either in the top end portion thereof and/or in the top flange adjacent to the top end portion thereof with a first connection aperture portion that extends in the longitudinal direction;
the first connection protruding portion in one of the mutually adjacent structural metal components is inserted into the first connection aperture portion in the other of the mutually adjacent structural metal components;
the bottom flange is provided on the distal end portion thereof with a second connection protruding portion that extends in a longitudinal direction;
the supporting portion is provided either in the bottom end portion thereof and/or in the bottom flange adjacent to the bottom end portion thereof with a second connection aperture portion that extends in the longitudinal direction; and
the second connection protruding portion in one of the mutually adjacent structural metal components is inserted into the second connection aperture portion in the other of the mutually adjacent structural metal components.

24. The floor structure according to claim 23, wherein
a plurality of the first connection protruding portions, the first connection aperture portions, the second connection protruding portions, and the second connection aperture portions are provided separately from each other in the longitudinal direction.

25. The floor structure according to claim 1, wherein
the mutually adjacent structural metal components are fixed together by means of semi-finished bolts, high strength bolts, drill screws, rivets, welding, or bonding.

26. The floor structure according to claim 1, wherein
at least one of the structural metal components is a floor beam structural metal component in which a bulging portion is formed as a result of the bottom flange bulging downwards from a bottom end portion of the supporting portion.

27. The floor structure according to claim 1, wherein
at least one of a noise-proofing material, a weight, a mechanical damper, and a granular material is provided between the bottom flange and the top flange.

28. The floor structure according to claim 27, wherein
the noise-proofing material is concrete.

29. The floor structure according to claim 1, wherein
at least one of electric cables, equipment piping, and ducts are provided between the bottom flange and the top flange.

30. The floor structure according to claim 1, wherein at least one plate material selected from a concrete panel, an aerated lightweight concrete panel (i.e., an ALC panel), a wooden board, slate, a ceramic board, a glass wool board, a plaster board, a metal panel, and a ceramic-based siding board is integrally fixed to the structural metal components on the top surface of the top flange and/or the bottom surface of the bottom flange.

31. The floor structure according to claim 1, wherein the bottom flange and the supporting portion are provided with a notch portion at an end portion in the longitudinal direction thereof; and the structural metal component is connected to a top surface of the structural framework of an erected construction via the notch portion.

32. The floor structure according to claim 1, wherein each of the structural metal components satisfies $L/t \leqq 115$, where L is a width of the top flange and t is a thickness of the top flange.

33. The floor structure according claim 1, wherein only the end structural metal component at the end portion of the floor structure includes the U-shaped end component.

34. The floor structure according claim 1, wherein a length of a base of the U-shaped end component is shorter than a length of the top flange or bottom flange of the end structural metal component at the end portion of the floor structure.

* * * * *